US011598144B2

(12) United States Patent
Schulman et al.

(10) Patent No.: US 11,598,144 B2
(45) Date of Patent: Mar. 7, 2023

(54) BOTTOM RAIL ASSEMBLY FOR A COVERING FOR AN ARCHITECTURAL STRUCTURE AND RELATED ASSEMBLY METHODS

(71) Applicant: Levolor, Inc., Atlanta, GA (US)

(72) Inventors: Michael Schulman, Decatur, GA (US); Raymond Morehouse, Johns Creek, GA (US); Eugene W. Thompson, Maceo, KY (US)

(73) Assignee: Levolor, Inc., Atlanta, GA (US)

( * ) Notice: Subject to any disclaimer, the term of this patent is extended or adjusted under 35 U.S.C. 154(b) by 170 days.

(21) Appl. No.: 16/811,280

(22) Filed: Mar. 6, 2020

(65) Prior Publication Data

US 2020/0284090 A1 Sep. 10, 2020

Related U.S. Application Data

(60) Provisional application No. 62/815,651, filed on Mar. 8, 2019.

(51) Int. Cl.
*E06B 9/322* (2006.01)
*E06B 9/325* (2006.01)

(52) U.S. Cl.
CPC ..... *E06B 9/322* (2013.01); *E06B 9/325* (2013.01); *E06B 2009/3222* (2013.01)

(58) Field of Classification Search
CPC ... E06B 9/322; E06B 9/325; E06B 2009/3222
See application file for complete search history.

(56) References Cited

U.S. PATENT DOCUMENTS 2,089,844 A * 8/1937 Alfe ..... H01R 13/642 439/680
2,591,750 A * 4/1952 Walker ..... E06B 9/384 160/178.3
2,716,448 A * 8/1955 Landess ..... E06B 9/384 160/173 R
2,824,608 A † 2/1958 Etten
2,860,699 A * 11/1958 Braun ..... E06B 9/388 160/173 R (Continued)

FOREIGN PATENT DOCUMENTS

WO WO2004053279 6/2004
WO WO2008119968 10/2008

(Continued)

OTHER PUBLICATIONS

European Search Report issued in corresponding Application No. EP 20161260.3 dated Aug. 4, 2020 (8 pages).

*Primary Examiner* — Johnnie A. Shablack
(74) *Attorney, Agent, or Firm* — Dority & Manning, P.A.

(57) ABSTRACT

In various aspects, a covering for an architectural structure includes a bottom rail assembly that can be efficiently and effectively assembled during manufacturing of the covering. Specifically, in one embodiment, the bottom rail is configured such that one or more operating system components of the covering can be mounted within and directly supported by the bottom rail. In addition, a separate cover may be coupled to the bottom rail during the assembly process.

11 Claims, 13 Drawing Sheets

(56) References Cited

U.S. PATENT DOCUMENTS

| | | | | |
|---|---|---|---|---|
| 4,515,201 | A * | 5/1985 | Anderson | E06B 9/384 160/174 R |
| 4,945,970 | A * | 8/1990 | Marocco | E06B 9/324 160/178.2 |
| 6,186,211 | B1 | 2/2001 | Knowles | |
| 6,463,985 | B1 | 10/2002 | Hsu | |
| 6,558,184 | B1 * | 5/2003 | Melocchi | H01R 25/14 439/417 |
| 6,644,372 | B2 * | 11/2003 | Judkins | E06B 9/32 160/170 |
| 6,675,861 | B2 | 1/2004 | Palmer et al. | |
| 6,929,049 | B2 | 8/2005 | Nicolosi | |
| 7,096,917 | B2 † | 8/2006 | Ciuca | |
| 7,330,629 | B2 * | 2/2008 | Cooke | G02B 6/4471 385/139 |
| 7,591,297 | B2 * | 9/2009 | Lee | E06B 9/32 160/176.1 R |
| 7,896,056 | B2 | 3/2011 | Ben-David | |
| 7,913,738 | B2 * | 3/2011 | Fraser | E06B 9/307 160/176.1 R |
| 7,987,890 | B2 | 8/2011 | Wilson | |
| 8,191,602 | B1 | 6/2012 | Motosko | |
| 8,437,597 | B2 * | 5/2013 | Cooke | G02B 6/4471 385/135 |
| 8,739,853 | B2 * | 6/2014 | Judkins | E06B 9/322 160/171 |
| 8,770,257 | B2 | 7/2014 | Kao | |
| 8,887,786 | B2 * | 11/2014 | Anderson | E06B 9/262 160/167 R |
| 9,314,125 | B2 * | 4/2016 | Anthony | E06B 9/322 |
| 9,357,868 | B2 * | 6/2016 | Anderson | A47H 3/10 |
| 9,422,766 | B2 * | 8/2016 | Anderson | E06B 9/90 |
| 9,482,048 | B2 * | 11/2016 | Anderson | E06B 9/325 |
| 9,593,528 | B2 * | 3/2017 | Anderson | E06B 9/327 |
| 9,677,330 | B2 * | 6/2017 | Anderson | E06B 9/262 |
| 9,708,850 | B2 * | 7/2017 | Anderson | E06B 9/322 |
| 10,138,674 | B2 * | 11/2018 | Hsu | E06B 9/32 |
| 10,145,171 | B2 * | 12/2018 | Anderson | E06B 9/325 |
| 10,215,944 | B2 * | 2/2019 | Sedor | G02B 6/4455 |
| 10,557,304 | B2 * | 2/2020 | Anderson | E06B 9/324 |
| 10,603,187 | B2 * | 3/2020 | Laubert | A61F 2/30942 |
| 10,954,716 | B2 * | 3/2021 | Anderson | E06B 9/326 |
| 11,180,952 | B2 * | 11/2021 | Anderson | E06B 9/322 |
| 2002/0157796 | A1 * | 10/2002 | Judkins | E06B 9/32 160/170 |
| 2007/0017165 | A1 | 1/2007 | Richardson | |
| 2007/0158035 | A1 * | 7/2007 | Larsson | E06B 9/388 160/168.1 R |
| 2008/0041534 | A1 | 2/2008 | Jensen | |
| 2008/0087387 | A1 † | 4/2008 | Chen | |
| 2008/0093033 | A1 † | 4/2008 | Hsu | |
| 2009/0173459 | A1 | 7/2009 | Hsu et al. | |
| 2012/0159733 | A1 * | 6/2012 | Kwon | B60S 1/3801 15/250.3 |
| 2012/0267060 | A1 * | 10/2012 | Anderson | E06B 9/322 160/307 |
| 2014/0048220 | A1 * | 2/2014 | Cheng | E06B 9/262 160/368.1 |
| 2014/0246156 | A1 | 9/2014 | Domy et al. | |
| 2016/0010389 | A1 | 1/2016 | Anderson et al. | |
| 2016/0356083 | A1 | 12/2016 | Gilmer | |
| 2017/0081916 | A1 | 3/2017 | Greening | |
| 2017/0226794 | A1 * | 8/2017 | Huang | E06B 9/322 |
| 2018/0148974 | A1 | 3/2018 | Roberts et al. | |
| 2020/0284090 | A1 * | 9/2020 | Schulman | E06B 9/322 |
| 2022/0024417 | A1 * | 1/2022 | Poton | B60S 1/40 |
| 2022/0065038 | A1 * | 3/2022 | Liang | E06B 9/30 |

FOREIGN PATENT DOCUMENTS

| | | |
|---|---|---|
| WO | WO2009001114 | 12/2008 |
| WO | WO2016031761 | 3/2016 |
| WO | WO2016103123 | 6/2016 |
| WO | WO2017089863 | 6/2017 |
| WO | WO2018051309 | 3/2018 |

* cited by examiner
† cited by third party

BOTTOM RAIL ASSEMBLY FOR A COVERING FOR AN ARCHITECTURAL STRUCTURE AND RELATED ASSEMBLY METHODS

CROSS-REFERENCE TO RELATED APPLICATIONS

The present application is based upon and claims the right of priority to U.S. Provisional Patent Application No. 62/815,651, filed Mar. 8, 2019, the disclosure of which is hereby incorporated by reference herein in its entirety for all purposes.

FIELD

The present subject matter relates generally to coverings for architectural structures, such as windows, and, more particularly, to an improved bottom rail assembly for use with a covering, such as a Venetian blind, and related assembly methods.

BACKGROUND

Coverings, such as horizontal/Venetian blinds and other similar blinds, typically include a headrail, a bottom rail, and a plurality of horizontally oriented slats configured to be supported between the headrail and the bottom rail via two or more sets of cord ladders. Additionally, one or more lift cords typically extend between the headrail and the bottom rail for adjusting the position of the bottom rail relative to the headrail. In many instances, each lift cord passes through a set of aligned route holes defined in the slats.

Moreover, traditional Venetian blinds typically include an operating cord extending downwardly along one of the sides of the blind that must be manipulated by the user to raise and lower the blind relative to the adjacent architectural structure. However, more recently, cordless Venetian blinds have been developed that eliminate the external operating cords. For instance, Venetian blinds are commercially available from Turnils North America that include a LIFT & LOCK™ cordless operating system, with the various components of the blind's lift system (e.g., the lift stations, spring motor, and associated drive shaft) being housed within the bottom rail. To raise and lower a blind including the above-described cordless operating system, the user presses a push button positioned along the exterior of the bottom rail to actuate a braking mechanism operatively coupled to the drive shaft, thereby unlocking the drive shaft and allowing the lift system to operate when raising/lowering the blind. With such a configuration, the associated spring motor is typically underpowered and, thus, the braking mechanism may be used to assist in holding the bottom rail in position when released by the user.

While the above-described cordless Venetian blinds provide various operating and consumer-related advantages, such blinds present some challenges during manufacturing and assembly. Specifically, the above-described cordless Venetian blinds include an elongated filler strip to which the various components of the blind's lift system are mounted. During assembly, the lift system components, such as the lift stations and the braking mechanism, are initially mounted on the filler strip. In addition, the various cords of the blind, such as the lift cords and cord ladders, are assembly relative to the filler stip. Thereafter, the bottom rail of the blind must be assembled relative to the filler strip and the other components mounted thereto (the strip and other components being collectively referred to as the "filler strip assembly") by sliding the bottom rail along the length of such filler strip assembly. Such a sliding-based installation of the bottom rail relative to the pre-assembled filler strip assembly presents some challenges. For example, this assembly process requires a work space within a manufacturing environment that is dimensionally at least twice as long as the width of the blind being assembled (i.e., at least twice as long as the length of the bottom rail) given that the bottom rail and the filler strip assembly must be placed end-to-end to allow the sliding process to be initiated. Moreover, as the bottom rail is slid along the length of the filler strip assembly, various clearance issues typically exist between the bottom rail and the various components that have been pre-assembled onto the filler strip. For example, an assembly worker may have to stop several times to adjust the positioning of one or more of the lift system components to allow the bottom rail to be slid past such component(s). Furthermore, given its pre-assembled state on the filler strip, it is often quite difficult to ensure that the braking mechanism is properly positioned relative to the bottom rail once the rail has been slide entirely onto the filter strip assembly.

In addition to developments in cordless Venetian blinds, efforts have also been made to address the route holes defined in the slats. Specifically, as indicated above, each lift cord of a Venetian blind is typically passed through a set of aligned route holes defined in the slats. Unfortunately, given their shape and typical dimensions, conventional route holes generally allow for light to pass through a blind when the slats have been tilted to their fully closed position. Additionally, the light gaps defined between the lift cord and the outer perimeter of conventional route holes often allow for a view through the blind when the blind is closed, thereby creating privacy concerns for homeowners with such blinds. To address such light-blocking and privacy concerns, "privacy" Venetian blinds have been developed that eliminate the route holes from the slats and include front and rear lift cords that extend along the front and rear sides of the slats to allow the bottom rail to be raised and lowered relative to the headrail.

The challenges associated with the sliding-based assembly process for the above-described commercially available cordless Venetian blind are further compounded when attempting to apply such a process to a "privacy" Venetian blind. Specifically, the lift cords positioned along the front and rear sides of the blind present further obstacles when attempting to slide the bottom rail along the length of a pre-assembled filler strip assembly. For example, once assembled relative to the filler strip, the front and rear lift cords are positioned at the front and rear edges, respectively of the filler strip. As a result, one or more of the lift cords may catch on the leading edge of the bottom rail or other features of the rail as the rail is being slid relative to the filler strip assembly.

Accordingly, an improved configuration for a bottom rail assembly for a covering, such as a Venetian blind, as well as related methods for assembling such a bottom rail assembly, would be welcomed in the technology.

BRIEF SUMMARY

Aspects and advantages of the present subject matter will be set forth in part in the following description, or may be obvious from the description, or may be learned through practice of the present subject matter.

In various aspects, the present subject matter is directed to a covering for an architectural structure that includes a bottom rail assembly that can be efficiently and effectively assembled during manufacturing of the covering. Specifically, in several embodiments, the bottom rail is configured such that one or more operating system components of the covering can be mounted within and supported directly by the bottom rail.

Additionally, in various aspects, the present subject matter is also directed to a bottom rail assembly for a covering for an architectural structure that includes a separate cover configured to be coupled to the bottom rail of the assembly. Specifically, in several embodiments, the cover comprises a snap-on component of the bottom rail assembly that is configured to be snapped into position relative to the bottom rail, thereby allowing for quick and efficient assembly of the cover/rail.

Moreover, the present subject matter is also directed to methods for assembling one or more embodiments of the covering disclosed herein, including one or more embodiments of the bottom rail assembly disclosed herein.

These and other features, aspects, and advantages of the present subject matter will become better understood with reference to the following Detailed Description and appended claims. The accompanying drawings, which are incorporated in and constitute a part of this specification, illustrate embodiments of the present subject matter and, together with the description, serve to explain the principles of the present subject matter.

This Brief Description is provided to introduce a selection of concepts in a simplified form that are further described below in the Detailed Description. This Brief Description is not intended to identify key features or essential features of the claimed subject matter, nor is it intended as an aid in determining the scope of the claimed subject matter.

BRIEF DESCRIPTION OF THE DRAWINGS

A full and enabling disclosure of the present subject matter, including the best mode thereof, directed to one of ordinary skill in the art, is set forth in the specification, which makes reference to the appended figures, in which.

DETAILED DESCRIPTION

Figure 1:
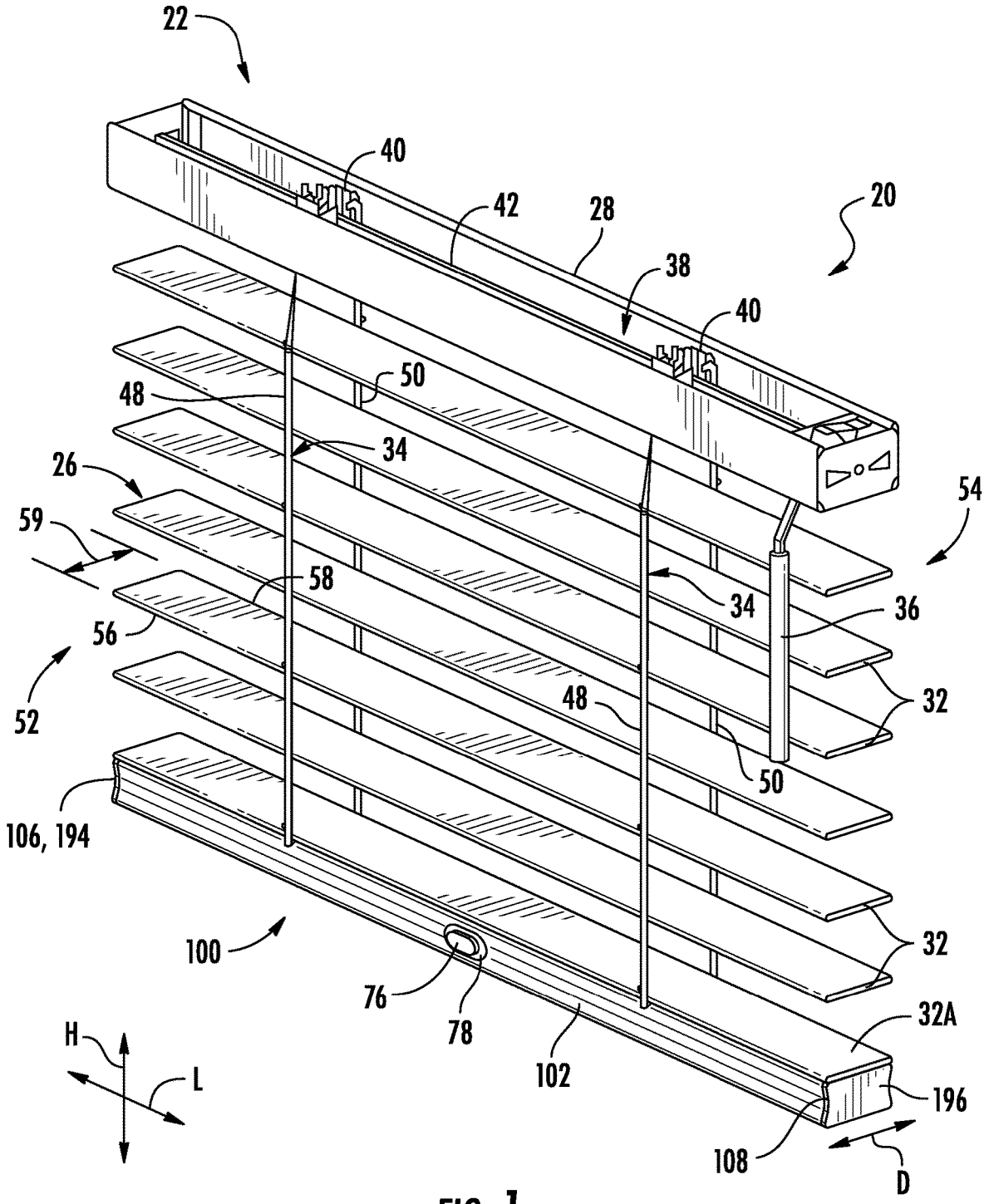
FIG. 1 illustrates a perspective view of one embodiment of a covering for an architectural structure in accordance with aspects of the present subject matter.

In general, the present subject matter is directed to an improved bottom rail assembly configured for use with a covering for an architectural feature or structure (referred to herein simply as an architectural "structure" for the sake of convenience and without intent to limit). In addition, the present subject matter is directed to related assembly methods for assembling the disclosed covering, including methods for assembling the various operating system components of the bottom rail assembly as well as methods for assembling additional components of the covering (e.g., various cords) relative to the bottom rail assembly. It should be appreciated that, for purposes of discussion, the disclosed covering will generally be described herein as a Venetian blind and numerous advantages associated with the present subject matter will be described in the context of improvements over conventional Venetian blinds and their related assembly methods. However, one of ordinary skill in the art should readily appreciate that various aspects of the present subject matter may also incorporated into other types of coverings. For example, aspects of the disclosed bottom rail assembly may be used in connection with various types of coverings beyond Venetian blinds.

In several embodiments, a bottom rail of the disclosed bottom rail assembly is configured such that one or more operating system components of the related covering are capable of being mounted within and supported directly by the bottom rail. As a result, the operating system components can be pre-assembled directly within the bottom rail, thereby eliminating the need to separately assemble such system components onto a filler strip that must then be properly installed relative to the bottom rail by sliding the rail along the length of the filler strip (and the various components mounted thereto). Accordingly, the overall assembly process may be greatly simplified, particularly in comparison to conventional assembly methods for cordless Venetian blinds.

In addition, the ability to couple operating system components directly to the bottom rail allows for more accurate positioning of each individual component within the interior of the rail as compared to when such components are fixed to a separate filler strip and then slidably installed as an assembly relative to the rail. Such accurate placement of the operating system components relative to the bottom rail may be particularly advantageous for cordless blinds that include a user-actuatable component (e.g., a button) positioned along the exterior of the bottom rail that must be properly aligned with a brake or braking mechanism positioned within the interior of the rail. For instance, in accordance with aspects of the present subject matter, the brake may be inserted directly within the interior of the bottom rail and properly positioned relative to the location at which the button will be installed on the rail prior to securing the brake to the rail. As a result, the brake/button may be precisely aligned in a more consistent manner during the assembly process.

Additionally, in accordance with aspects of the present subject matter, the disclosed bottom rail assembly also includes a separate cover configured to be coupled to the bottom rail. In several embodiments, the cover comprises a snap-on component of the bottom rail assembly that is configured to be snapped into position relative to the bottom rail, thereby allowing for quick and efficient assembly of the cover/rail (e.g., as compared to a sliding-based installation). For example, in one embodiment, the cover may include opposed retention elements configured to engage corresponding retention elements defined along opposed sides of an open end of the bottom rail. In such an embodiment, the retention elements of the cover may snap into position relative to the retention elements of the rail as the cover is pressed against the bottom rail or vice versa.

In one embodiment, the bottom rail includes a top wall forming the top side of the rail and first and second sidewalls extending outwardly from the top wall to form the front and rear sides of the rail. In such an embodiment, when assembling the bottom rail assembly, one or more operating system components of the covering may be secured directly to the top wall of the bottom rail such that the component(s) is supported by the top wall within the interior of the bottom rail between its opposed sidewalls. For instance, one or more components of the lift system, such as the brake and lift stations, may be coupled directly to the top wall via suitable mounting structure associated with the top wall (e.g., mounting apertures defined through the top wall). In such an embodiment, the various other lift system components, such as the lift rod and spring motor, may then be installed within the bottom rail relative to the components secured to the top wall.

For example, in one embodiment of the present subject matter, a covering for an architectural structure includes a headrail assembly and a bottom rail assembly supported relative to the headrail assembly via one or more lift cords. The bottom rail assembly includes a bottom rail have a top wall extending along a top side of the bottom rail, and opposed first and second sidewalls extending from the top wall along respective first and second sides of the bottom rail towards a bottom side of the bottom rail. In addition, the bottom rail assembly includes a lift system positioned within an interior of the bottom rail and operable to raise and lower the bottom rail assembly relative to the head rail assembly by adjusting an effective length of the one or more lift cords extending between the headrail and bottom rail assemblies, with the lift system including at least one system component mounted to the top wall of the bottom rail. Moreover, the bottom rail assembly includes a user actuatable component positioned relative to one of the first sidewall or the second sidewall along an exterior of the bottom rail. The user actuatable component is configured to be actuated to control an operation of the lift system.

In one embodiment, the system component comprises a braking mechanism or brake and the user actuatable component comprises a button. In such an embodiment, the button is configured to actuate the brake between a locked position, at which the brake engages a lift rod of the lift system to prevent rotation of the lift rod within the bottom rail, and an unlocked position, at which the brake disengages the lift rod to allow the lift rod to rotationally drive an associated lift station of the lift system.

In embodiments in which the various system components are configured to be coupled to the top wall of the bottom rail, the separate cover of the bottom rail assembly may be configured to be mounted to the bottom side of the rail. For instance, in one embodiment, the bottom rail may have an upside-down "U-shaped" profile defined by the top wall and opposed sidewalls such that an open bottom end is defined along the bottom side of the rail. In such an embodiment, the cover may be configured to be installed along the bottom side of the rail in order to cover the open bottom end, such as by pressing the cover against the bottom end to snap the cover into position relative to the bottom rail.

Moreover, in accordance with aspects of the present subject matter, the disclosed snap-on cover may also be used as the structure to which one or more of the operating system components are mounted. Specifically, in several embodiments, as an alternative to mounting the system components directly to the bottom rail, such components may be mounted or pre-assembled onto the cover. The cover and associated components assembled thereon may then be snapped directly onto the bottom rail. Such an assembly method provides a significant improvement over the conventional sliding-based installation process described above.

For example, in one embodiment of the present subject matter, a covering for an architectural structure includes a headrail assembly and a bottom rail assembly supported relative to the headrail assembly via one or more lift cords. The bottom rail assembly includes a bottom rail having a first wall, a second wall, and first and second rail retention elements provided in operative association with the first and second walls, respectively. In addition, the bottom rail assembly includes a separate cover configured to be coupled to the bottom rail such that the bottom rail and the cover at least partially define an interior volume of the bottom rail assembly. The cover includes first and second cover retention members configured to be snapped into position relative to the first and second rail retention elements, respectively, of the bottom rail to secure the cover to the bottom rail. Moreover, the bottom rail assembly includes a lift system comprising at least one system component mounted to one of the bottom rail or the cover such that the at least one system component is supported within the interior volume of the bottom rail assembly by one of the bottom rail or the cover.

Furthermore, it should be appreciated that, by eliminating the sliding-based installation, the disclosed bottom rail assembly and related assembly methods may be particularly advantageous for use with a "privacy" Venetian blind. Specifically, any issues associated with the front and rear lift cords catching on the bottom rail as the rail is slid past/across the lift cords and the components of a conventional filler strip assembly can be avoided completely. Rather, in accordance with aspects of the present subject matter, the front and rear lift cords can be routed directly though the component of the bottom rail assembly to which the lift system components have been mounted (e.g., the top wall of the bottom rail or the cover depending on the configuration/orientation of the bottom rail assembly). Moreover, in doing so, the locations at which the lift cords are routed through bottom rail assembly may be selected so as to provide for optimal operation of the related covering, such as by ensuring that the entry locations or apertures for the lift cords along the bottom rail assembly are properly spaced so that the cords extend substantially vertically along the front and rear sides of the covering. For instance, in one embodiment, each pair of entry locations or apertures for the front and rear lift cords may be spaced apart from each other as far as possible across the bottom rail to allow for desired routing of the lift cords from the outer edges of the slats into the bottom rail.

As indicated above, the present subject matter is also directed to methods for assembling a covering for an architectural structure. In one embodiment, the method includes inserting at least one system component of a lift system of the covering between first and second sidewalls of a bottom rail of the covering and into an interior of the bottom rail. In addition, the method includes securing the system component(s) to a top wall of the bottom rail such that the system component(s) is supported between the first and second sidewalls of the bottom rail via the top wall. Moreover, the method includes installing a user actuatable component relative to one of the first sidewall or the second sidewall along an exterior of the bottom rail, wherein the user actuatable component is configured to be actuated to control an operation of the lift system.

Figure 2:
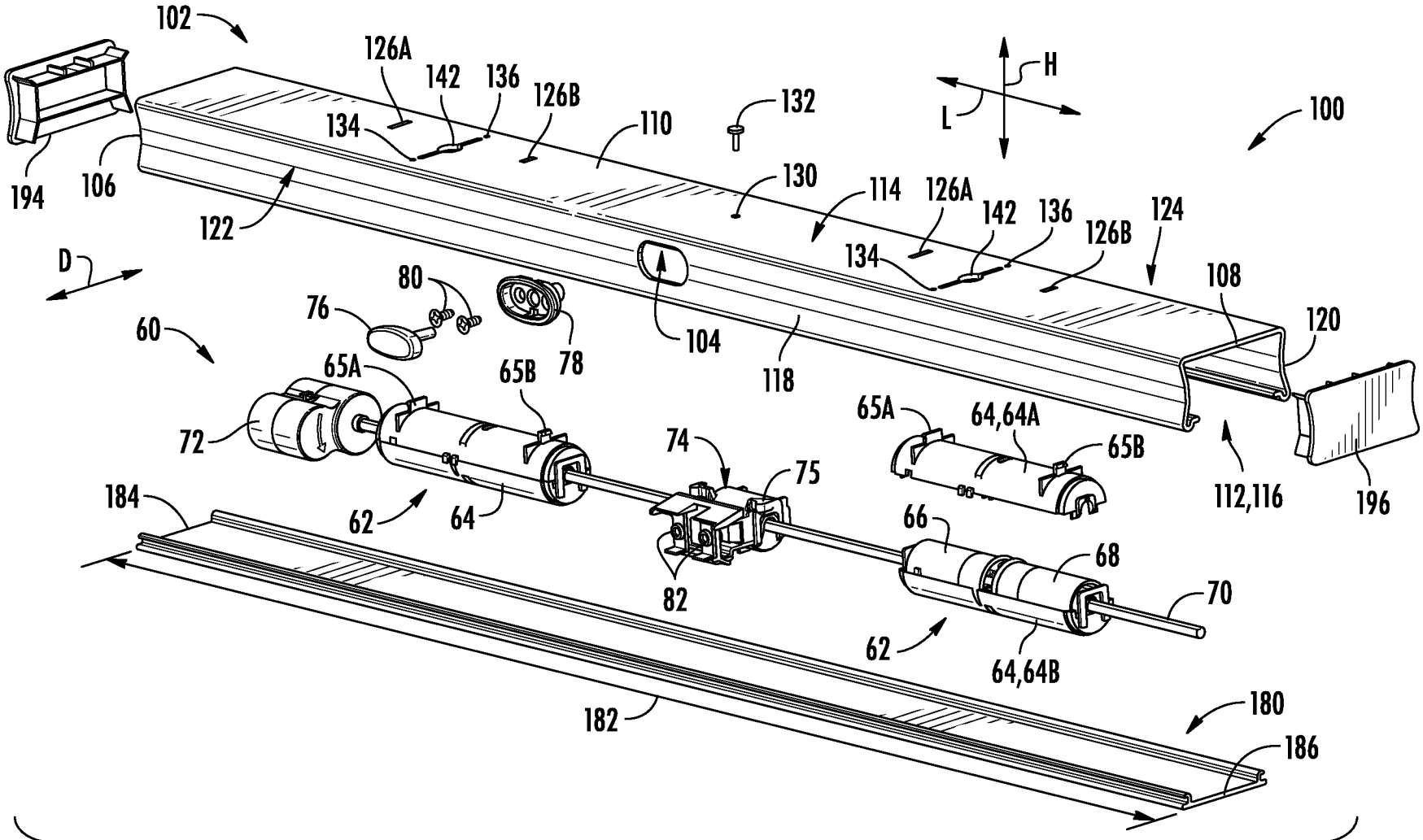
FIG. 2 illustrates an exploded perspective view of a bottom rail assembly of the covering shown in FIG. 1 in accordance with aspects of the present subject matter.

Referring now to FIGS. 1 and 2, differing views of one embodiment of a covering 20 for an architectural structure (not shown) are illustrated in accordance with aspects of the present subject matter. Specifically, FIG. 1 illustrates a perspective view of the covering 20, and FIG. 2 illustrates an exploded perspective view of a bottom rail assembly of the covering 20 shown in FIG. 1.

In general, the covering 20 may be configured to be installed relative to a window, door, or any other suitable architectural structure as may be desired. In one embodiment, the covering 20 may be configured to be mounted relative to an architectural structure to allow the covering 20 to be suspended or supported relative to the architectural structure. It should be understood that the covering 20 is not limited in its particular use as a window or door shade, and may be used in any application as a covering, partition, shade, and/or the like, relative to and/or within any type of architectural structure.

In several embodiments, the covering 20 may be configured as a cordless Venetian-blind-type extendable/retractable covering. For example, in the embodiment shown in FIGS. 1 and 2, the covering 20 includes a headrail assembly 22, a bottom rail assembly 100, and one or more covering elements 26 extending between the headrail assembly 22 and the bottom rail assembly 100. As shown in FIG. 1, the headrail assembly 22 generally includes a headrail 28 and one or more operating system components configured to be positioned within the headrail 28 (e.g., one or more tilt system components). Similarly, as shown in FIG. 2, the bottom rail assembly 100 generally includes a bottom rail 102 and one or more operating system components configured to be positioned within the bottom rail 102 (e.g., one or more lift system components). As will be described below, in several embodiments of the present subject matter, one or more of the operating system components provided in operative association with the bottom rail 102 may be configured to be directly mounted or coupled to a portion of the bottom rail 102.

In the illustrated embodiment, the covering element(s) 26 comprises a plurality of horizontally disposed parallel slats 32 configured to be supported between the headrail assembly 22 and the bottom rail assembly 100 via one or more cord ladders 34. As is generally understood, the slats 32 may be rotatable or tiltable about their longitudinal axes by manipulating the cord ladders 34 to allow the slats 32 to be tilted between a horizontal or open position (e.g., as shown in FIG. 1) for permitting light to pass between the slats 32, and a closed position (not shown), wherein the slats 32 are substantially vertically oriented in an overlapping manner to occlude or block the passage of light between the slats 32 and through the covering 20. It should be appreciated that the cord ladders 34 may be manipulated to allow for the slats 32 to be tilted between their open and closed positions using, for example, a suitable tilt wand 36 or any other suitable control device forming part of a tilt system 38 provided in operative association with the covering 20. As shown in FIG. 1, one or more components of the tilt system 32 are positioned within the headrail 28 and form part of the head rail assembly 22, such as a tilt station 40 provided in operative association with each cord ladder 34, and a tilt rod 42 operatively associating the tilt wand 36 with the tilt stations 40. In such an embodiment, as the tilt wand 36 is manipulated by the user (e.g., by rotating the tilt wand 36 relative to the headrail 28), the tilt rod 42 may be rotated to rotationally drive the tilt stations 40, thereby allowing a front ladder run 44 (FIG. 5) or a rear ladder run 46 (FIG. 5) of each cord ladder 34 to be raised or lowered relative to the other to adjust the tilt angle of the slats 32. It should be appreciated that each tilt station 40 may generally have any suitable configuration, including any conventional tilt station configuration and/or any other suitable configuration that allows the tilt stations 40 to function as described herein.

It should also be appreciated that, although the covering 20 is shown in the illustrated embodiment as including slats 32, the covering 20 may instead including any other suitable covering element(s) configured to extend between the headrail assembly 22 and the bottom rail assembly 100.

Moreover, the covering 20 may also include one or more lift cords (separate from the cord ladders 34) for moving the covering 20 between a lowered or extended position (e.g., as shown in FIG. 1) and a raised or retracted position (not shown). In several embodiments, the covering 20 may be configured as a "privacy" Venetian blind and, thus, may include one or more pairs of front and rear lift cords extending between the headrail assembly 22 and the bottom rail assembly 100. For instance, as shown in FIG. 1, the covering 20 includes two pairs of front and rear lift cords 48, 50 extending between the headrail assembly 22 and the bottom rail assembly 100. Each lift cord pair in FIG. 1 includes a front lift cord 48 extending along a front side 52 of the covering 20, and a rear lift cord 50 extending along a rear side 54 of the covering 20. Specifically, each front lift cord 48 may be configured to extend between the headrail assembly 22 and the bottom rail assembly 100 along a front edge 56 of each slat 32, while each rear lift cord 50 may be configured to extend between the headrail assembly 22 and the bottom rail assembly 100 along an opposed rear edge 58 of each slat 32. In one embodiment, the front side 52 of the covering 20 may generally be defined by a vertical plane in which the front edges 56 of the slats 32 lie and which extends between the headrail assembly 22 and the bottom rail assembly 100. Similarly, in one embodiment, the rear side 54 of the covering 20 may generally be defined by a vertical plane in which the rear edges 58 of the slats 32 lie and which extends between the headrail assembly 22 and the bottom rail assembly 100.

It should be appreciated that, in other embodiments, the covering 20 may only include a front lift cord 48 or a rear lift cord 50 at the locations of the lift cord pairs shown in FIG. 1. For example, in one embodiment, the covering 20 may include a front lift cord 48 extending between the headrail assembly 22 and the bottom rail assembly 100 along the front edge 56 of each slat 32 at the location of one of the cord ladders 34 and a rear lift cord 50 extending between the headrail assembly 22 and the bottom rail assembly 100 along the rear edge 58 of each slat 32 at the location of the other cord ladder 34. It should also be appreciated that, in alternative embodiments, the covering 20 may be configured as a non-privacy-type Venetian blind, with one or more lift cords extending between the headrail assembly 22 and the bottom rail assembly 100 through route holes defined in the slats 32.

In several embodiments, each lift cord 48, 50 may be configured to be provided in operative association with one or more components of a lift system 60 of the covering 20, with such lift system components configured to be positioned within the bottom rail 102 of the bottom rail assembly 100. For example, as shown in FIG. 2, the lift system 60 includes a lift station 62 for each corresponding pair of lift cords 48, 50. In such an embodiment, each pair of lift cords 48, 50 may be operatively coupled to its respective lift station 62 within the interior of the bottom rail 102. For instance, a bottom end (not shown) of each lift cord 48, 50 may be configured to be coupled to its associated lift station 60 while an opposed end (not shown) of each lift cord 48, 50 may be configured to be coupled to the headrail 28.

In one embodiment, each lift station 62 may include a housing 64 and one or more lift spools for winding and unwinding the respective pairs of lift cords 48, 50. For instance, as shown in the view of FIG. 2 in which an upper housing component 64A of the housing 64 of one of the lift stations 62 has been exploded away from an associated lower housing component 64B of the housing 64, each lift station 62 includes a pair of lift spools (e.g., a first or front lift spool 66 and a second or rear lift spool 68) for winding and unwinding the respective lift cords 48, 50 of each pair of lift cords. Thus, as the bottom rail assembly 100 is raised relative to the headrail assembly 22, each lift cord 48, 50 may be wound around its respective lift spool 66, 68. Similarly, as the bottom rail assembly 100 is lowered relative to the headrail assembly 22, each lift cord 48, 50 may be unwound from its respective lift spool 66, 68. In other words, an effective length of each lift cord 48, 50 (i.e., the length of each cord 48, 50 extending directly between the bottom rail assembly 100 and the headrail assembly 22) may generally vary as the bottom rail assembly 100 is raised and lowered relative to the headrail assembly 22. Specifically, the effective length of each lift cord 48, 50 decreases as the bottom rail assembly 100 is raised towards the headrail assembly 22 and increases as the bottom rail 100 is lowered away from the headrail assembly 22.

As shown in FIG. 2, the lift system 60 of the covering 20 also includes a lift rod 70 operatively coupled to the lift stations 62 and a spring motor 72 operatively coupled to the lift rod 70, with the lift rod 70 and the spring motor 72 configured to be positioned within the interior of the bottom rail 102. As is generally understood, the spring motor 72 may be configured to store energy as the bottom rail assembly 100 is lowered relative to the headrail assembly 22 and release such energy when the bottom rail assembly 100 is being raised relative to the headrail assembly 22 to assist in moving the covering 20 to its retracted or raised position. For instance, as the bottom rail assembly 100 is being raised relative to the headrail assembly 22, the spring motor 72 may transfer a driving torque to the lift rod 70 for rotationally driving the lift stations 62 in a manner that causes each lift cord 48, 50 to be wound around its respective lift spool 66, 68 of the associated lift station 62. Specifically, as the lift rod 70 rotates in one direction about its axis of rotation, each lift cord 48, 50 may wind around its respective lift spool 66, 68 to retract the covering 20. Similarly, as the lift rod 70 rotates in the opposite direction, each lift cord 48, 50 may unwind from its respective lift spool 66, 68 to extend the covering 20.

Additionally, in several embodiments, the lift system 60 may include a brake 74 provided within the bottom rail 102. In general, the brake 74 may be operatively coupled to the lift rod 70 in a manner that allows the brake 74 to selectively engage the lift rod 70. Specifically, in several embodiments, the brake 74 may be configured to be actuated between a locked or engaged position, at which the brake 74 engages the lift rod 70 so as to prevent rotation of the lift rod 70, and an unlocked or disengaged position, at which the brake 74 disengages the lift rod 70 to allow rotation of the lift rod 70 (and, thus, allow the rod 70 to rotationally drive the lift stations 62 via the driving torque provided by the spring motor 72). As shown in FIGS. 1 and 2, to actuate the brake 74, an operator or user-actuatable component is positioned along the exterior of the bottom rail 102. Specifically, in the illustrated embodiment, the user-actuatable component comprises an actuator button 76 configured to be supported relative to the bottom rail 102 along its exterior (e.g., via an optional button housing 78 associated with the button 76). For example, as shown in FIG. 2, the button housing 78 may be configured to be inserted through a button opening 104 defined through the bottom rail 102 and subsequently coupled to a portion of the brake (e.g., via fasteners 80 inserted through the housing 78 and into corresponding fastener openings 82 defined in the brake 74 along its front face), with the button 76 being supported within the button housing 78 along the exterior of the bottom rail 102. Alternatively, the button 76 may be configured to be installed relative to the bottom opening 104 without use of the associated button housing 78. In one embodiment, when the actuator button 76 is depressed by the user, the brake 74 may be actuated to its unlocked or disengaged position so as to release or disengage from the lift rod 70, thereby allowing the lift rod 70 to be rotated in a manner that permits the lift cords 48, 50 to be wound around or unwound from their respective lift spools as the bottom rail assembly 100 is lowered or raised, respectively, relative to the headrail assembly 22. Similarly, when the actuator button 76 is released by the user, the brake 74 may move back to its locked or engaged position (e.g., via operation of a biasing spring or other mechanism) so as to engage the lift rod 70, thereby preventing rotation of the lift rod 70 and, thus, maintaining the position of the bottom rail assembly 100 relative to the headrail assembly 22. Embodiments of exemplary brake/button arrangements are described, for example, in U.S. Pat. No. 9,422,766 (Anderson et al.) and U.S. Pat. No. 9,708,850 (Anderson et al.), both of which are hereby incorporated by reference herein in their entirety for all purposes. It should be appreciated that, in embodiments including the button housing 78, the housing 78 may have any suitable configuration that allows the button 76 to be supported relative to the bottom rail 102 along the exterior of the rail 102. For example, in one embodiment, the button housing 78 may be configured as a handle mounted along the exterior of the of the bottom rail 102, with the button 76 being supported by the handle relative to the rail 102.

As particularly shown in FIG. 2, the bottom rail 102 of the bottom rail assembly 100 includes a first lateral end 106 and a second lateral end 108 and extends longitudinally in a lateral direction of the covering 20 (indicated by arrow L in FIGS. 1 and 2) between the first and second lateral ends 106, 108. In addition, in the illustrated embodiment, the bottom rail 102 defines an upside-down "U-shaped" profile and includes both a top wall 110 and an opposed open bottom end 112 extending in the lateral direction L between the first and second lateral ends 106, 108 of the bottom rail 102. The top wall 110 may generally be configured to define a top side 114 of the bottom rail 102 that generally faces in the direction of the opposed headrail assembly 22 of the covering 20. Similarly, the bottom end 112 is generally defined along a bottom or lower side 116 of the bottom rail 102 that is configured to face away from the headrail assembly 22. Additionally, as shown in FIG. 2, the bottom rail 102 includes opposed first and second sidewalls 118, 120 spaced apart from each other in a depthwise direction of the covering 20 (indicated by arrow D in FIGS. 1 and 2) and extending directly between the top wall 110 and the bottom end 112 of the bottom rail 102. Specifically, the first and second sidewalls 118, 120 are configured to extend in a heightwise direction of the covering 20 (indicated by arrow H in FIGS. 1 and 2) between the top and bottom sides 114, 116 of the bottom rail 102 so as to define opposed front and rear sides 122, 124 (FIG. 2) of the bottom rail 102. For instance, in one embodiment, the first sidewall 118 may be configured to define the front side 122 of the bottom rail 102 and, thus, may generally extend in the heightwise direction H along the front side 52 (FIG. 1) of the covering 20. In such an embodiment, the second sidewall 120 may be configured to define the rear side 124 of the bottom rail 102 and, thus, may generally extend in the heightwise direction H along the rear side 54 (FIG. 1) of the covering 20.

As will be described in greater detail below, in several embodiments, one or more of the components of the lift system 60 may be configured to be mounted to the top wall 110 of the bottom rail 102 such that each component is suspended or supported within the interior of the bottom rail 102 between the opposed sidewalls 118, 120 via the top wall 110. Specifically, in several embodiments, a plurality of mounting and/or assembly features may be defined in or otherwise provided in operative association with the top wall 110 for both mounting the lift system components to the bottom rail 102 and for receiving the various cords of the covering 20. Such a configuration allows the lift system components to be assembled relative to one another directly within the bottom rail 102, with the lift cords 48, 50 passing through the top wall 110 of the bottom rail 102 and into the respective lift stations 62. Accordingly, the need to separately assemble the lift system components and corresponding lift cords 48, 50 relative to a separate filler strip that must then be attached to the bottom rail 102 by sliding the rail 102 along the length of the filler strip and across the various lift system components and lift cords assembled relative thereto is completely eliminated, thereby greatly simplifying the overall assembly process for the bottom rail assembly 100. It should be appreciated that, when mounting and/or assembly features (e.g., apertures or through-holes) are defined in or otherwise provided in operative association with the top wall 110, a cover strip or slat may be provided to hide such features from view. For instance, as shown in FIG. 1, a bottom slat 32A of the covering 20 may serve as a cover slat configured to cover any mounting and/or assembly features provided in operative association with the top wall 110 (FIG. 2) of the bottom rail 102.

In several embodiments, as particularly shown in FIG. 2, the bottom rail assembly 100 also includes a cover 180 configured to be installed along the bottom side 116 of the bottom rail 102 to cover the open bottom end 112 of the rail 102. Specifically, as will be described in greater detail below, the cover 180 may, in one embodiment, be installed relative to the bottom side 116 of the bottom rail 102 once the various lift system components have been assembled within the bottom rail 102 (e.g., via mounting one or more such components to the top wall 110 of the rail 102), thereby enclosing the lift system components within the interior of the rail 102. As shown in FIG. 2, the cover 180 may, in one embodiment, define a length 182 between opposed lateral ends 184, 186 of the cover 180 that is generally equal or substantially equal to the length of the bottom rail 102 defined in the lateral direction L between the corresponding lateral ends 106, 108 of the rail 102. As such, the cover 180 may extend entirely or substantially entirely between the opposed lateral ends 106, 108 along the bottom side 116 of the rail 102. Additionally, as will be described below, in one embodiment, the cover 180 may be configured as a snap-on component of the bottom rail assembly 100, thereby allowing the cover 180 simply to be pressed, pushed or otherwise snapped into engagement with the bottom rail 102. As will be apparent from the disclosure provided herein, such a snap-on cover may further enhance the ease with which the bottom rail assembly 100 may be assembled during manufacturing of the disclosed covering 20.

Moreover, the bottom rail assembly 100 may, in several embodiments, include a pair of endcaps 194, 196 installed on the bottom rail 102 at its opposed lateral ends 106, 108. Specifically, as shown in FIG. 2, a first endcap 194 is configured to be installed at the first lateral end 106 of the bottom rail 102 while a second endcap 196 is configured to be installed at the second lateral end 108 of the bottom rail 102. The endcaps 194, 196 may generally be configured to cover the openings defined at the lateral ends 106, 108 of the bottom rail 102 to prevent dust and other contaminates from being introduced into the interior of the bottom rail 102. In addition, the endcaps 194, 196 may help in providing the bottom rail 102 with a desired aesthetic appearance.

It should be appreciated that, although the bottom rail assembly 100 has been described above with reference to FIGS. 1 and 2 as including a combination of specific components (e.g., the bottom rail 102, the cover 180, the endcaps 194, 196, and the various components of the lift system 60, such as the lift stations 62, the lift rod 70, the spring motor 72, the brake 74, the button 76, and the optional button housing 78), such components should be understood to be independent of and separate from one another and, thus, are shown together for the sake of convenience and without intent to limit the present subject matter to requiring the components to always be present and used together in the combination shown in the illustrated embodiment. For instance, one or more of the components of the bottom rail assembly 100 may be removed and/or substitute for a different component, as would be understood to one of ordinary skill in the art. Similarly, it should be appreciated that, although the lift system 60 has been described above with reference to FIG. 2 as including a combination of specific components (e.g., the lift stations 62, the lift rod 70, the spring motor 72, the brake 74, the button 76, and the optional button housing 78), such components should be understood to be independent of and separate from one another and, thus, are shown together for the sake of convenience and without intent to limit the present subject matter to requiring the components to always be present and used together in the combination shown in the illustrated embodiment.

Figure 3:
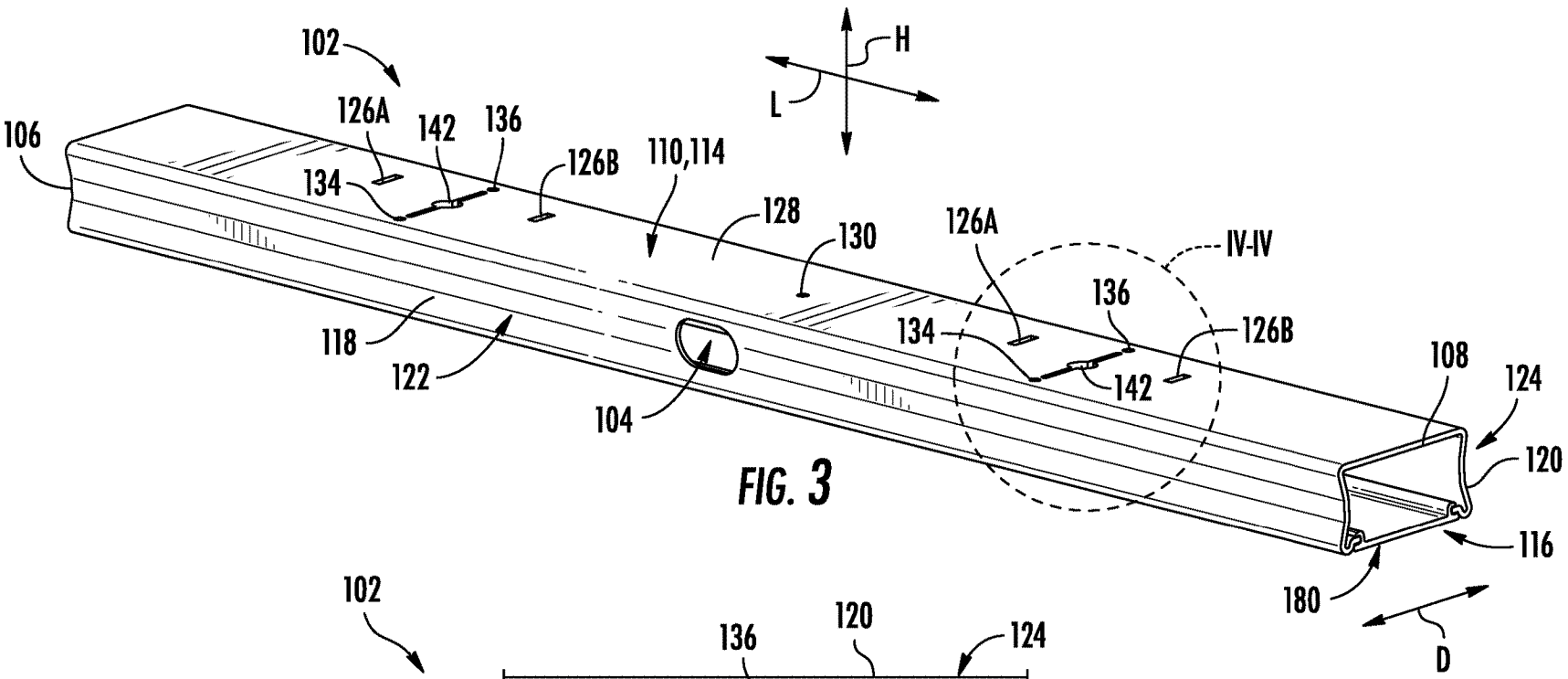
FIG. 3 illustrates a perspective view of the bottom rail of the bottom rail assembly shown in FIGS. 1 and 2 in accordance with aspects of the present subject matter.
Figure 4:
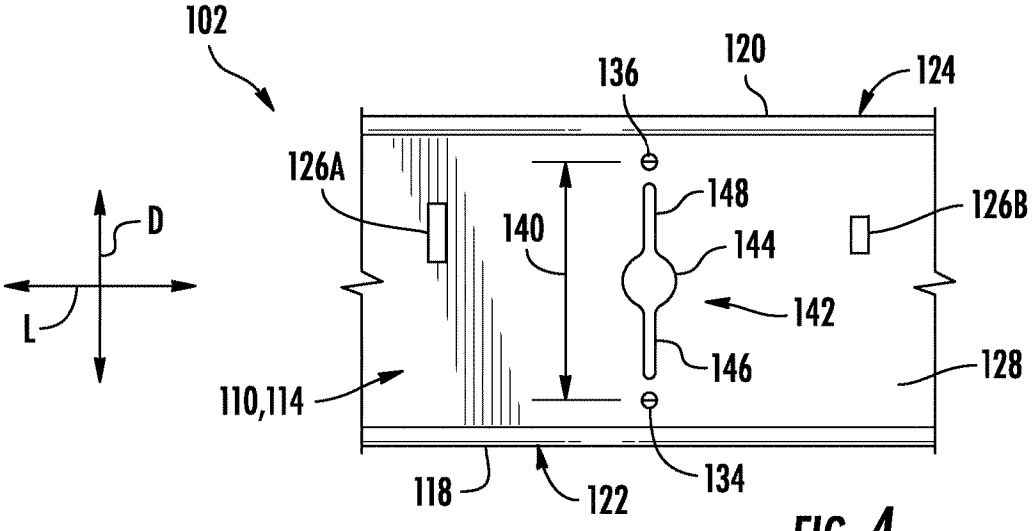
FIG. 4 illustrates a top view of the portion of the bottom rail contained within the dashed circle IV-IV shown in FIG. 3.
Figure 5:
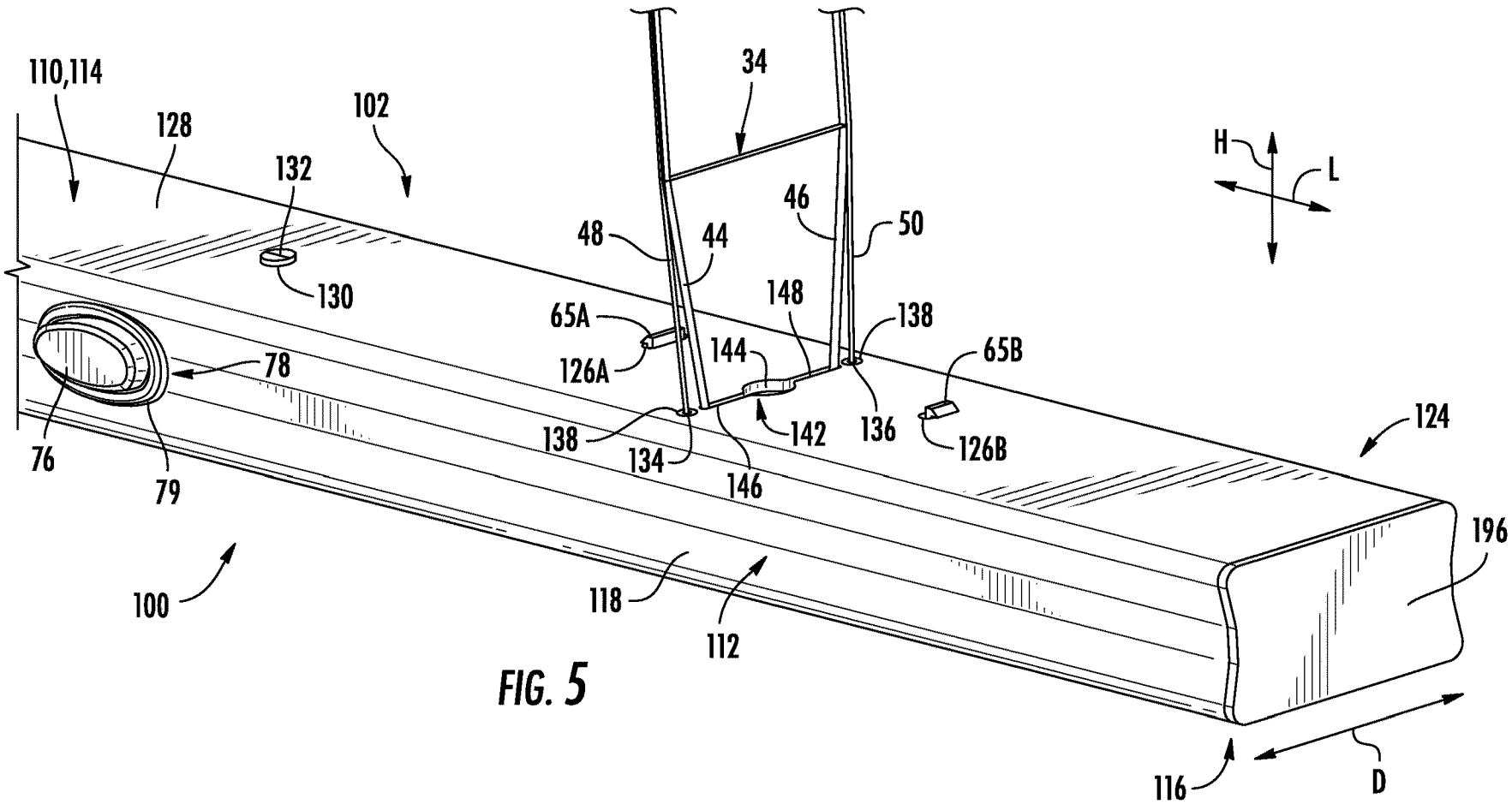
FIG. 5 illustrates a perspective view of a portion of the bottom rail with various lift system components and cords of the disclosed covering installed relative to the bottom rail in accordance with aspects of the present subject matter.

Referring now to FIGS. 3-5, differing views of the bottom rail 102 of the bottom rail assembly 100 described above with reference to FIGS. 1 and 2 are illustrated in accordance with aspects of the present subject matter. Specifically, FIG. 3 illustrates a perspective view of the bottom rail 102 (with the cover 180 installed thereon) while FIG. 4 illustrates a top view of a portion of the bottom rail 102 contained within the dashed circle IV-IV of FIG. 3. In addition, FIG. 5 illustrates a perspective view of a portion of the bottom rail 102 with the various lift system components and cords of the disclosed covering 20 installed relative to the bottom rail 102.

As indicated above, a plurality of mounting and/or assembly features may be defined in or otherwise provided in operative association with the top wall 110 of the bottom rail 102 for both mounting the lift system components to the bottom rail 110 and receiving the various cords of the covering 20. For example, in several embodiments, suitable mounting structure may be defined in or otherwise provided in association with the top wall 110 for mounting or coupling one or more of the lift system components to the bottom rail 102. In one embodiment, the mounting structure corresponds to a plurality of mounting apertures defined through the top wall 110 of the bottom rail 102. Specifically, as shown in FIG. 3, one or more station mounting apertures 126 (e.g., a pair of station mounting apertures, such as a first station mounting aperture 126A and a second station mounting aperture 126B) are defined through the top wall 110 of the rail 102 at the location at which each lift station 62 is configured to be installed within the bottom rail 102. In one embodiment, each station mounting aperture 126A, 126B is configured to receive a corresponding mounting feature or component of the lift station 62 intended to be coupled to the rail 102 at the location of such aperture 126A, 126B. For example, referring back to FIG. 2, each lift station includes a pair of mounting projections or hooks (e.g., a first mounting 65A and a second mounting hook 65B) extending outwardly from the housing 64 of each lift station 62 (e.g., the upper housing component 64A of each housing 64). In such an embodiment, the mounting hooks 65A, 65B may be configured to be inserted through the station mounting apertures 126A, 126B from the interior of the bottom rail 102 to allow the hooks 65A, 65B to engage an outer surface 128 of the top wall 110. For example, each lift station 62 may be configured to be inserted within the interior of the bottom rail 102 via the open bottom end 112 of the rail 102 and pushed towards the top wall 110 of the rail 102 until the associated mounting hooks 65A, 65B snap into the respective pair of station mounting apertures 126A, 126B or are otherwise engaged with the top wall 110 of the rail 102 via the station mounting apertures 126A, 126B. As shown in FIG. 5, upon installing each lift station 62 relative to the bottom rail 102, a portion of each mounting hook 65A, 65B extends outwardly from the top wall 110 and engages the outer surface 128 of such wall 110. As an alternative, a suitable fastener (e.g., pin) may be inserted through each station mounting aperture 126A, 126B and into engagement with a corresponding feature of the associated lift station 62 to allow the lift stations 62 to be coupled to the top wall 110 of the bottom rail 102.

In one embodiment, the lift station mounting structure on the bottom rail 102 and/or the associated mounting features of the lift stations 62 may be configured such that each lift station 62 may only be coupled to the top wall 110 of the bottom rail 102 in a specific orientation relative to the rail 102. For example, the station mounting apertures 126A, 126B of the bottom rail 102 and/or the mounting hooks 65A, 65B of the lift stations 62 may be sized and/or shaped so as to require installation of each lift station 62 in the desired orientation relative to the rail 102. Specifically, in the illustrated embodiment shown in FIGS. 2 and 5, the mounting projections or hooks 65A, 65B of each lift station 62 are sized differently, such as by configuring the first mounting hook 65A to be larger than the second mounting hook 65B. In such an embodiment, the first and second station mounting apertures 126A, 126B of the bottom rail 102 may be similarly sized to receive the first and second mounting hooks 65A, 65B, respectively. For example, as particularly shown in FIG. 4, the first station mounting aperture 126A is sized relative to the second station mounting aperture 126B (e.g., by being larger than the second station mounting aperture 126B) so as to allow the larger first mounting hook 65A to be inserted through the first station mounting aperture 126A. In such an embodiment, the smaller second station mounting aperture 126B may be sized such that the first mounting hook 65A cannot be inserted through such aperture 126B, thereby ensuring that each lift station 62 is installed relative to the bottom rail 102 in the desired orientation. Such dimensioning of the mounting structure provides a poka-yoke feature for installation of the lift stations 62 relative to the rail 102 to avoid errors or mis-assembly during the assembly process. It should be appreciated that, in addition to using different sizes for the station mounting apertures 126A, 126B (or as an alternative thereto), the first and second station mounting apertures 126A, 126B may be configured to define different shapes to ensure that each lift station 62 is installed relative to the bottom rail 102 in the desired orientation, such as by configuring the first station mounting aperture 126A to have a square or rectangular shape while configuring the second station mounting aperture 126B to have a different shape (e.g., a circular or triangular shape or any other differing polygonal shape).

Additionally, as shown in FIG. 3, one or more brake mounting apertures 130 may be defined through the top wall 110 for coupling the brake 74 of the lift system 60 to the bottom rail 102. For instance, in one embodiment, a suitable fastener (e.g., the pin 132 shown in FIGS. 2 and 5) may be inserted through the brake mounting aperture 130 and into a corresponding feature of the brake 74 (e.g., a mounting flange 75 (FIG. 2) of the brake 74) to couple the brake 74 to the top wall 110 of the bottom rail 102. As particularly shown in FIG. 5, upon installing the brake 74 relative to the bottom rail 102, a portion of the pin 132 extends outwardly from the top wall 110 and engage the outer surface 128 of such wall 110. Alternatively, similar to the mounting hooks 65A, 65B of each lift station 62, the brake 74 may include a mounting feature configured to be received through the brake mounting aperture 130 to allow the brake 74 to be coupled to the top wall 110 of the bottom rail 102.

It should be appreciated that, although not shown, suitable mounting structure may also be provided in association with the bottom rail 102 to allow the spring motor 72 to be mounted to the rail 102. For instance, in one embodiment, one or more suitable motor mounting apertures may be defined through the top wall 110 of the rail 102 for coupling the spring motor 72 to the rail 102.

It should also be appreciated that, although the top wall 110 of the bottom rail 102 has generally been described above as including mounting apertures 126, 130 for coupling the lift system components to the bottom rail 102, the top wall 110 may, in alternative embodiments, include or otherwise be associated with any other suitable mounting structure that allows the lift system components to be coupled thereto. For instance, suitable mounting structure may include recesses or other recessed features defined in or coupled to the top wall 110, dimples, projections, or other mounting features extending from the top wall 110, and/or any other suitable mounting structure that would be known to those of ordinary skill in the art.

Moreover, in addition to the various mounting apertures 126, 130 for coupling the lift system components to the bottom rail 102, the top wall 110 may also define a plurality of cord apertures through which the various cords of the covering 20 are passed. For instance, as shown in FIG. 3, front and rear lift cord apertures 134, 136 may be defined through the top wall 110 for passing each corresponding pair of front and rear lift cords 48, 50 through the top wall 110 of the rail 102. In such an embodiment, each lift cord 48, 50 may, for example, be inserted or routed through its respective lift cord aperture 134, 136 prior to being coupled to the appropriate lift spool 66, 68 of the lift station 62 configured to be mounted to the top wall 110 via the adjacent pair of station mounting apertures 126A, 126B. Additionally, as particularly shown in FIG. 5, in one embodiment, eyelets 138 or other friction-reducing components may be installed within each lift cord aperture 134, 136 to prevent wear on the lift cords 48, 50 due to potential rubbing between the cords 48, 50 and the bottom rail 102.

As particularly shown in the top view of FIG. 4, the front and rear lift cord apertures 134, 136 are spaced apart from each other along the top wall 110 of the bottom rail 102 by a given depthwise distance 140 in the depthwise direction D of the covering 20. In several embodiments, the depthwise distance 140 may be selected so as to be equal or substantially equal to a depthwise cord spacing 59 (FIG. 1) defined between the front and rear cords 48, 50 when the slats 32 are tilted to their fully opened position (e.g., as shown in FIG. 1). In such embodiments, the front and rear lift cords 48, 50 may be routed through the top wall 110 with the same or similar depthwise spacing as that defined between the lift cords 48, 50 as the cords 48, 50 extend along the fully opened slats 32. As a result, the lift cords 48, 50 may extend substantially vertically along the front and rear sides 52, 54 (FIG. 1) of the covering 20 between the headrail 28 and the bottom rail 102 with the slats 32 at the opened position, which may reduce the tension within the lift cords 48, 50 (particularly within the portions of the cords 48, 50 extending between the top wall 110 of the rail 102 and the tilt stations 62). However, in other embodiments, the depthwise distance 140 defined between the front and rear lift cord apertures 134, 136 may be less than or greater than the depthwise cord spacing 59 defined between the front and rear cords 48, 50 when the slats 32 are tilted to their fully opened position. It should also be appreciated that the maximum depthwise distance 140 defined between the front and rear lift cord apertures 134, 136 will be limited by the overall depth of the bottom rail 102. For instance, in one embodiment, the depth or width of the bottom rail 102 may be equal or substantially equal to the width of the slats 32 defined between their front and rear edges 56, 58. In such an embodiment, it may be desirable to space the front and rear lift cord apertures 134, 136 as far apart as possible along the width/depth of the bottom rail 102 to allow the lift cords 48, 50 to maintain a substantially vertical orientation as they are routed through the bottom rail 102.

Additionally, cord ladder apertures 142 may be defined through the top wall 110 for receiving the front and rear runs 44, 46 (FIG. 5) of each cord ladder 34. For example, as particularly shown in FIG. 4, in one embodiment, each cord ladder aperture 142 is configured as an elongated opening including an enlarged central region 144 and front and rear narrowed regions 146, 148 extending outwardly from the central region 144 in the depthwise direction D of the covering 20. In such an embodiment, when the ends of the front and rear runs 44, 46 of each cord ladder 34 are knotted, grommeted, or otherwise enlarged, the enlarged ends of the ladder runs 44, 46 may be inserted through the top wall 110 of the bottom rail 102 via the central region 144 of the associated cord ladder aperture 142. As particularly shown in FIG. 5, the front and rear ladder runs 44, 46 may then be moved from the central region 144 into the front and rear narrowed regions 146, 148 of the aperture 142, respectively, such that the enlarged ends of the ladder runs 44, 46 engage the inner surface of the top wall 110 along such narrowed regions 146, 148, thereby securing the cord ladder 34 to the top wall 110 of the bottom rail 102. For example, the narrowed regions 146, 148 may be sized such that the enlarged ends of the ladder runs 44, 46 cannot pass through such regions 146, 148.

As indicated above with reference to FIG. 2, the bottom rail 102 may also define a button opening 104 for installing the actuator button 76 and associated button housing 78 relative to the bottom rail 102. For example, as shown in FIG. 3, the button opening 104 is defined through the first sidewall 118 along the front side 122 of the bottom rail 102 at or adjacent to the location at which the brake 74 is configured to be coupled to the top wall 110 of the rail 102 (e.g., via the associated brake mounting aperture 130). Specifically, as will be described below in relation to the related assembly method, the lateral positioning of the brake 74 may be selected such that, when the brake 74 is properly installed relative to the bottom rail 102, the portion of the brake 74 configured to be secured to the button/housing 76, 78 is aligned with the button opening 104 in both the lateral direction L and the heightwise direction H of the covering 20, thereby allowing the button/housing 76, 78 to be at least partially inserted through the opening 104 and subsequently coupled to the brake 74 (e.g., via the fasteners 80 (FIG. 2) and associated fastener openings 82 (FIG. 2) of the brake 74) without requiring any significant additional adjustment of the relative positioning of such components. Additionally, in several embodiments, the button/housing 76, 78 may be installed within and/or relative to the button opening 104 such that the button 76 extends outwardly from the first sidewall 118 and is accessible along the exterior of the bottom rail 102, thereby allowing the user to push or press the button 76 inwardly relative to the bottom rail 102 to actuate or move the brake 74 from its locked/engaged position to its unlocked/disengaged position. For instance, as shown in FIG. 5, when installed along the front side 122 of the bottom rail 102, a portion of the button housing 78 (e.g., a mounting flange 79 of the housing 78) may engage or contact the first sidewall 118 around the perimeter of the button opening 104, with the button 76 extending outwardly from the housing 78 along the exterior of the bottom rail 102. In such an embodiment, the button 76 may be slidably or movably disposed within the housing 78 to allow the button 76 to be pushed inwardly (e.g., inwardly through the button opening 104) to actuate the brake 74.

Figure 6:
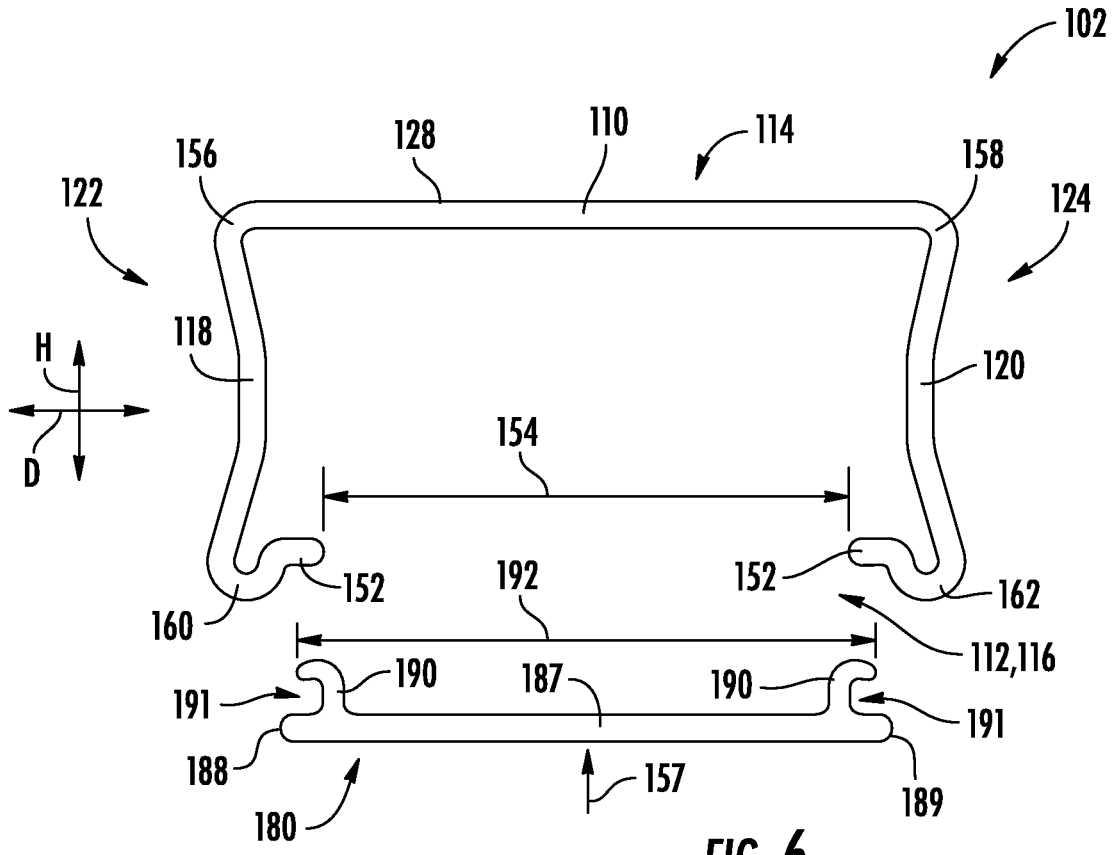
FIG. 6 illustrates an exploded, side view of the bottom rail and cover shown in FIG. 2 in accordance with aspects of the present subject matter.
Figure 7:
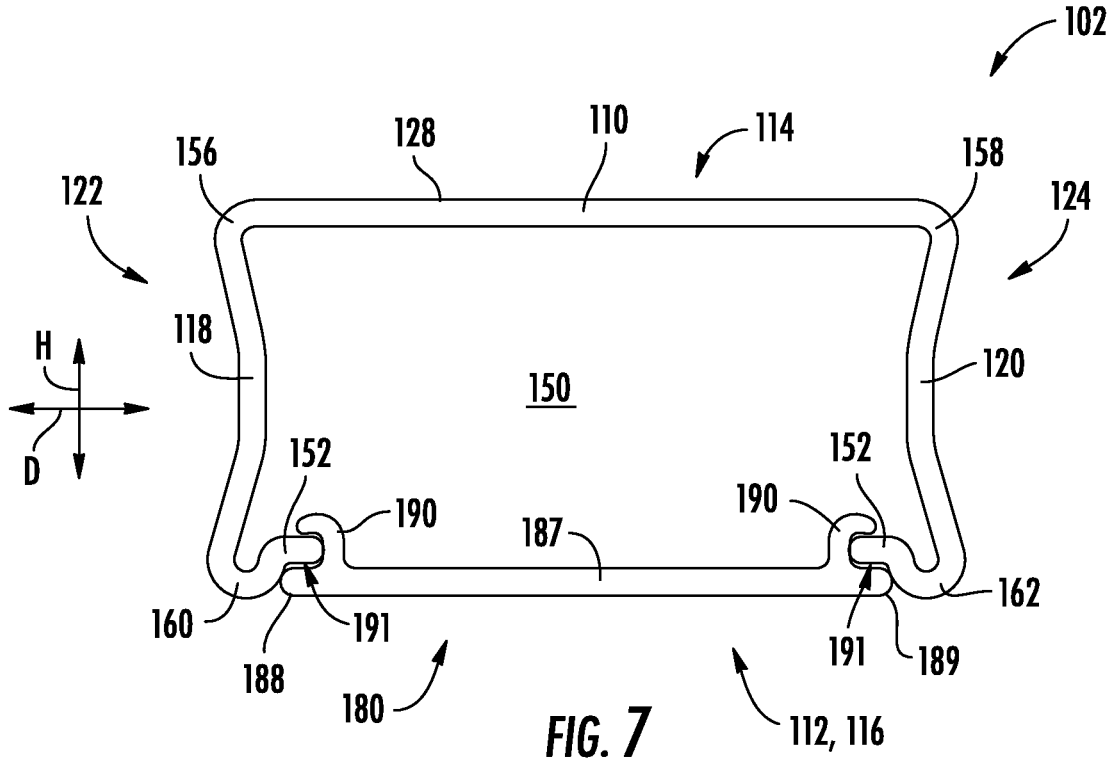
FIG. 7 illustrates an assembled, side view of the bottom rail and cover shown in FIG. 6 in accordance with aspects of the present subject matter.

Referring now to FIGS. 6 and 7, exploded and assembled side views, respectively, of the bottom rail 102 and the covering 180 of the bottom rail assembly 100 described above are illustrated in accordance with aspects of the present subject matter. As indicated above, in several embodiments, the cover 180 may be configured to be installed along the bottom side 116 of the rail 102 such that the open bottom end 112 of the rail 102 is covered, thereby enclosing the interior of the rail 102. For instance, as shown in FIG. 7, the cover 180 may be configured to extend to between the first and second sidewalls 118, 120 of the bottom rail in the depthwise direction D along the bottom side 116 of the rail 102 such that the bottom rail 102 and cover 180 at least partially define an interior volume 150 of the bottom rail assembly 100.

In general, the bottom rail 102 and the cover 180 may have any suitable configuration that allows the cover 180 to be coupled to the rail 102. However, as indicated above, in several embodiments, the cover 180 may be configured to be snapped onto the bottom rail 102. For example, as shown in FIGS. 6 and 7, the cover 180 includes a base wall 187 extending in the depthwise direction D between front and rear edges 188, 189 of the cover 180 and in the lengthwise direction L between the opposed lateral ends 184, 186 (FIG. 2) of the cover 180. Additionally, the cover 180 may include mounting or retention elements extending outwardly from the base cover wall 187 that are configured to be snapped into engagement with corresponding retention elements of the bottom rail 102, thereby allowing the cover 180 to be quickly and easily coupled to the bottom rail 102. Specifically, as shown in FIGS. 6 and 7, the cover 180 includes opposed, hooked retention walls 190 extending outwardly from the base wall 187 such that an outwardly facing retention slot 191 is defined between each retention wall 190 and the base wall 187 adjacent to the front and rear edges 188, 189 of the cover 180. In such an embodiment, the bottom rail 102 may be provided with complementary retention elements along its open bottom end 112 that are configured to be received within the opposed retention slots 191 when the hooked retention walls 190 are snapped over and/or behind such elements. For example, as shown in the illustrated embodiment, the bottom rail 102 includes opposed retention flanges 152 extending inwardly from the first and second sidewalls 118, 120 of the rail 102 along the rail's bottom side 116. As particularly shown in FIG. 7, a depthwise distance 154 defined between the inner edges of the retention flanges 152 along the bottom side 116 of the rail 102 may be slightly smaller than a corresponding depthwise distance 192 defined between the outer edges of the hooked retention walls 190. As a result, when the cover 180 is pressed onto the bottom end 112 of the rail 102 (e.g., in the direction indicated by arrow 157 in FIG. 6), the hooked retention walls 190 (and/or the cover 180, in general) may flex slightly inward relative to the front and rear sides 122, 124 of the bottom rail 102 until the retention walls 190 clear the retention flanges 152, at which point the hooked walls 190 may snap over and/or behind the flanges 152 to trap the flanges 152 within the retention slots 191 defined along the opposed front and rear edges 188, 189 of the cover 180. As particularly shown in FIG. 7, upon installation of the cover 180 onto the bottom rail 102, the cover 180 may, in one embodiment, be seated flush with the bottom end 112 of the rail 102 such that the rail/cover assembly generally defines a planar profile along the bottom side 116 of the rail 102. As an alternative to pressing the cover 180 onto the bottom end 112 of the rail 102 in the installation direction 157 shown in FIG. 6 such that both of the hooked retention walls are pressed against the retention flanges 152 at the same time or substantially the same time, a more pivot-type assembly method may be utilized. For instance, the cover 180 may be initially tilted relative to the bottom end 112 of the rail 102 to allow one of the hooked retention walls 190 to be installed relative to its respective retention flange 152. In such an embodiment, the opposed edge 188, 189 cover 180 may then be pivoted towards the bottom end 112 of the rail 102 to allow the hooked retention walls 190 positioned at such opposed edge to be snapped into engagement with its respective retention flange 152.

Additionally, it should be appreciated that, as an alternative snapping the cover 180 onto the bottom rail 102, the cover 180 may, instead, be slid onto the bottom rail 102 along the lateral direction L of the covering 20. For instance, cover 180 may be aligned end-to-end with the bottom rail 102 such that the retention flanges 152 are received within the corresponding retention slots 191 at the adjacent lateral ends of the cover/rail. The cover 180 may then be slid along the length of the rail 102 in the lateral direction L until the cover 180 is fully installed onto the rail 102.

However, as indicated above, it should be appreciated that, while the disclosed cover configuration allows for a sliding-based installation, numerous advantages may be achieving using the above-described snap-based installation. Specifically, by configuring the cover 180 as a snap-on component, the cover 180 may be assembled onto the bottom rail 102 more efficiently and with greater ease than requiring the cover 180 to be slid onto the rail 102 along its entire length. In addition, the ability to snap the cover 180 onto the bottom rail 102 may greatly reduce the amount of work space required to assemble such components. For example, when sliding the cover 180 onto the bottom rail 102 in the lateral direction L, a work space is required that has an accessible working distance equal to at least twice the length of the bottom rail 102 in order to align the cover/rail end-to-end, which can be quite a significant distance when assembling longer or wider coverings. In contrast, the cover 180 can be snapped onto the bottom rail 102 within a work space having an accessible working distance that is simply equal to the length of the bottom rail 102.

Referring still to FIGS. 6 and 7, as indicated above, the bottom rail 102 may, in several embodiments, have an upside-down "U-shaped" profile defined by the top wall 110 and opposed sidewalls 118, 120 of the rail 102. In such embodiments, the bottom rail 102 may comprise a single unitary component, with the top wall 110, the first and second sidewalls 118, 120, and the associated retention flanges 152 being formed integrally with one another. For instance, as shown in FIGS. 6 and 7, front and rear upper corners 156, 158 of the bottom rail 102 may be defined at the intersections between the top wall 110 and the first and second sidewalls 118, 120, respectively, that correspond to bends formed in the overall body of the bottom rail 102 to create the desired rail profile between the top side 114 and opposed front and rear sides 122, 124 of the rail 102. Similarly, as shown in FIGS. 6 and 7, front and rear lower corners 160, 162 of the bottom rail 102 may be defined at the intersections between the first and second sidewalls 118, 120 and the respective retention flanges 152 extending therefrom that correspond to additional bends formed in the overall body of the bottom rail 102 to create the desired profile between the bottom side 116 and opposed front and rear sides 122, 124 of the rail 102.

Referring now to FIGS. 8-12, a sequence of views illustrating one example of a method for assembling various components of the disclosed covering 20 relative to the bottom rail 102 are illustrated in accordance with aspects of the present subject matter. For purposes of discussion, the various components configured to be assembled relative to the bottom rail 102 will generally be described herein with reference to FIGS. 8-12 as being installed in a particular order or sequence. However, one of ordinary skill in the art should readily appreciate that such components may be assembled relative to the bottom rail 102 in any other suitable order or sequence consistent with the disclosure provided herein.

Figure 8:
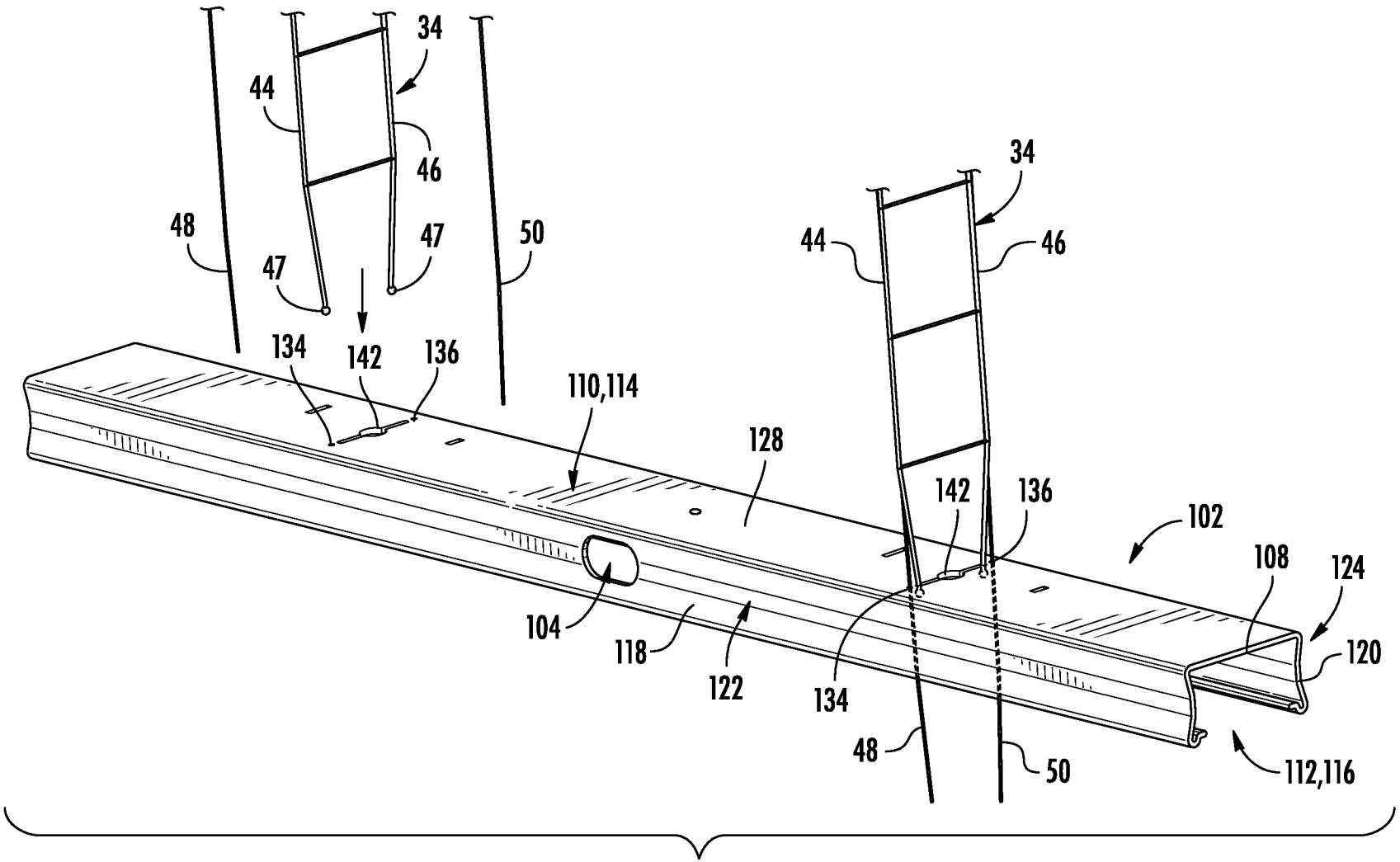
FIGS. 8-12 illustrate perspective views of various components of the disclosed covering, particularly illustrating a sequence of views associated with one example of a method for assembling the various components relative to the bottom rail of the covering in accordance with aspects of the present subject matter.

As particularly shown in FIG. 8, in one embodiment, the various cords of the covering 20 may be initially installed relative to the bottom rail 102. For example, the lift cords 48, 50 may be routed through the top wall 110 of the bottom rail 102 via the various lift cord apertures 134, 136. Specifically, each front lift cord 48 may be routed through its respective front lift cord aperture 134 while each rear lift cord 50 may be routed through its respective rear lift cord aperture 136. Additionally, it should be appreciated that, when eyelets 138 (FIG. 5) or other friction-reducing components are configured to be installed within the lift cord apertures 134, 136, such components may be installed within each aperture 134, 136 prior to routing the lift cords 48, 50 therethrough.

Additionally, each of the cord ladders 34 may be coupled to the top wall 110 of the bottom rail 102 via the associated cord ladder apertures 142. As indicated above with reference to FIGS. 3-5, in several embodiments, the bottom ends of the front and rear ladder runs 44, 46 may be grommeted, knotted, and/or otherwise enlarged. For example, as shown in FIG. 8, grommets 47 have been installed at the bottom ends of the front and rear ladder runs 44, 46 of each cord ladder 34. In such an embodiment, the grommeted ends 47 of the front and rear ladder runs 34, 36 may be initially installed through the central region 144 (FIG. 4) of each cord ladder aperture 142 prior to sliding the front and rear ladder runs 44, 46 outwardly along the front and rear narrowed regions 146, 148 (FIG. 4), respectively, of each cord ladder aperture 142 to complete the assembly of the cord ladders 34 relative to the bottom rail 102.

Figure 9:
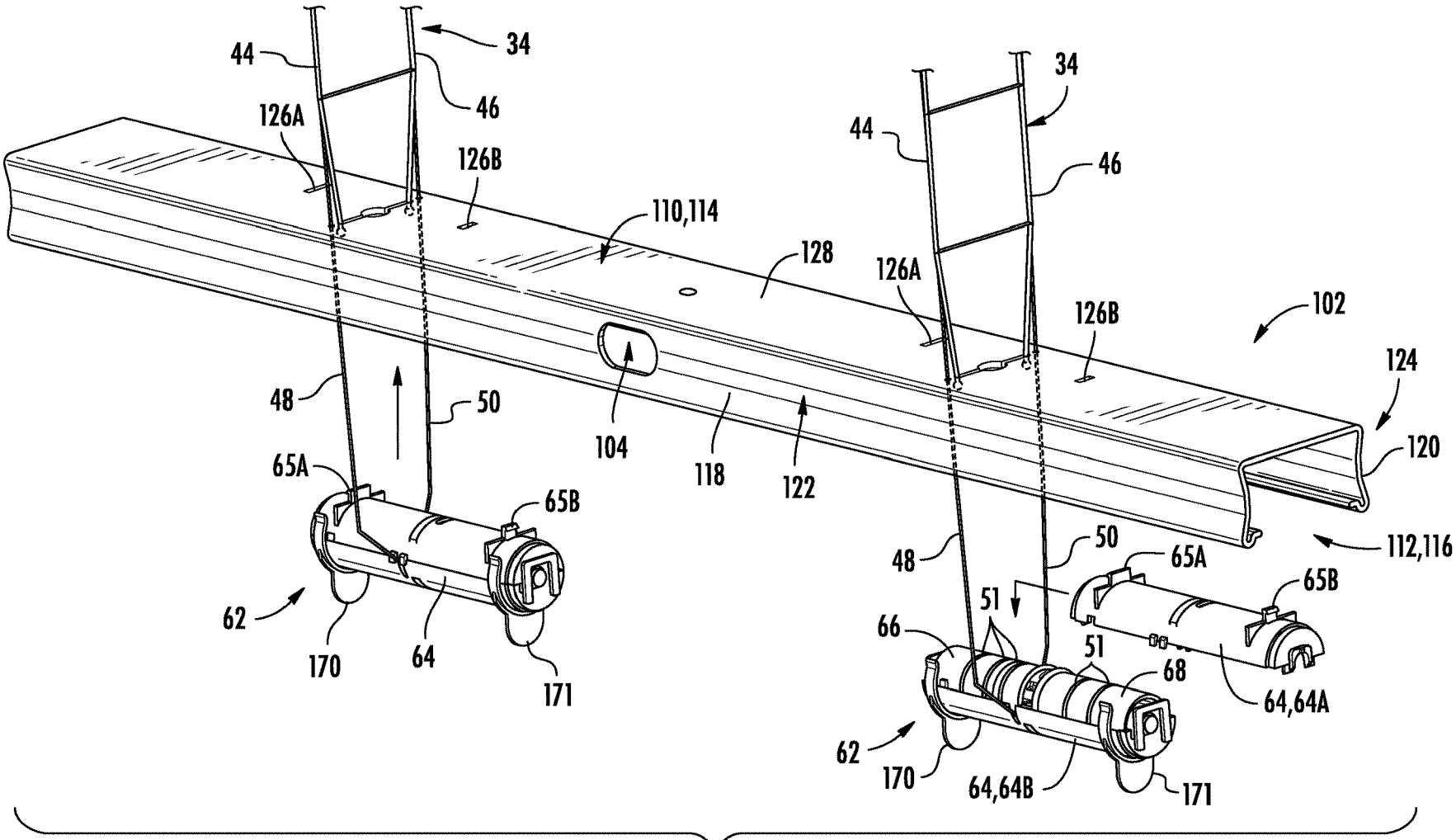

Referring now to FIG. 9, following the routing of the lift cords 48, 50 through the top wall 110 of the bottom rail 102 (e.g., via the lift cord apertures 134, 136), each pair of front and rear lift cords 48, 50 may be coupled to the corresponding lift spools 66, 68 of its respective lift station 62. For example, the end of each front lift cord 48 may be coupled to the front lift spool 66 of its respective lift station 62 while the end of each rear lift cord 50 may be coupled to the rear lift spool 68 of its respective lift station 62. In such an embodiment, the ends of the lift cords 48, 50 may be coupled to their respective lift spools 66, 68 using any suitable attachment methodology, such as by tying each end to a corresponding feature of the respective lift spool 66, 68 or by knotting each end and subsequently coupling the knotted end to a corresponding feature of the respective lift spool 66, 68. In addition to coupling the ends of the lift cords 48, 50 to their respective lift spools 66, 68, each lift cord 48, 50 may also be wrapped around its respective lift spool 66, 68 one or more times to create one or more cord wraps 51 (FIG. 9) around each lift spool 66, 68. Once the ends of the lift cords 48, 50 have been coupled to the respective lift spools 66, 68 (and/or once each lift cord 48, 50 has been at least partially wrapped around its respective lift spool 66, 68), the housing 64 of each lift station 62 may be assembled around the lift spools 66, 68, such as by coupling the upper housing component 64A of each lift station 62 to the lower housing component 64B of each lift station 62 such that the lift spools 66, 68 are encased between the upper and lower housing components 64A, 64B.

Additionally, in one embodiment, one or more temporary locking features may be configured to be installed relative to each lift station 62 to prevent rotation of the lift spools 66, 68 during the assembly process, particularly following installation of each lift cord 48, 50 relative to its respective lift spool 66, 68. For instance, as shown in FIG. 9, a pair of spool clips (e.g., a first spool clip 170 and a second spool clip 171) may be installed relative to each lift station 62. Specifically, in the illustrated embodiment, a first spool clip 170 is configured to be installed relative to each lift station 62 to rotationally fix or lock the first lift spool 66 relative to the housing 64 while a second spool clip 171 is configured to be installed relative to each lift station 62 to rotationally fix or lock the second lift spool 68 relative to the housing 64. By preventing rotation of the lift spools 66, 68 relative to the housing 64, the spool clips 170, 171 may function to inhibit the lift cords 48, 50 from unwrapping from or further wrapping around the spools 66, 68 as the associated lift station 62 is being installed relative to the bottom rail 102. For instance, in one embodiment, the spool clips 170, 171 may be configured to be installed relative to each lift station 62 after the lift cords 48, 50 have been wrapped around their respective spools 66, 68 (e.g., prior to or following assembly of the housing 64 around the lift spools 66, 68). Additionally, by fixing the circumferential orientation of both of the lift spools 66, 68 relative to the adjacent housing 64, the lift spools 66, 68 may be maintained at the proper orientation for inserting the lift rod 70 through the lift spools 66, 68 when using a keyed connection between the lift rod 70 and the spools 66, 68. For instance, the lift rod 70 may define a groove (e.g., a "V-shaped" groove) that is configured to be circumferentially aligned with a corresponding projection (e.g., a "V-shaped" projection) extending within the rod opening defined by each lift spool 66, 68. In such an embodiment, the spool clips 170, 171 may be installed relative to the lift station 62 once the lift spools 66, 68 have been properly oriented within the housing 64 (e.g., by orienting both lift spools 66, 68 at the same circumferential orientation within the housing 64), thereby allowing the proper spool orientation to be maintained until the lift rod 70 can be installed relative to the lift station 62.

Figure 13:
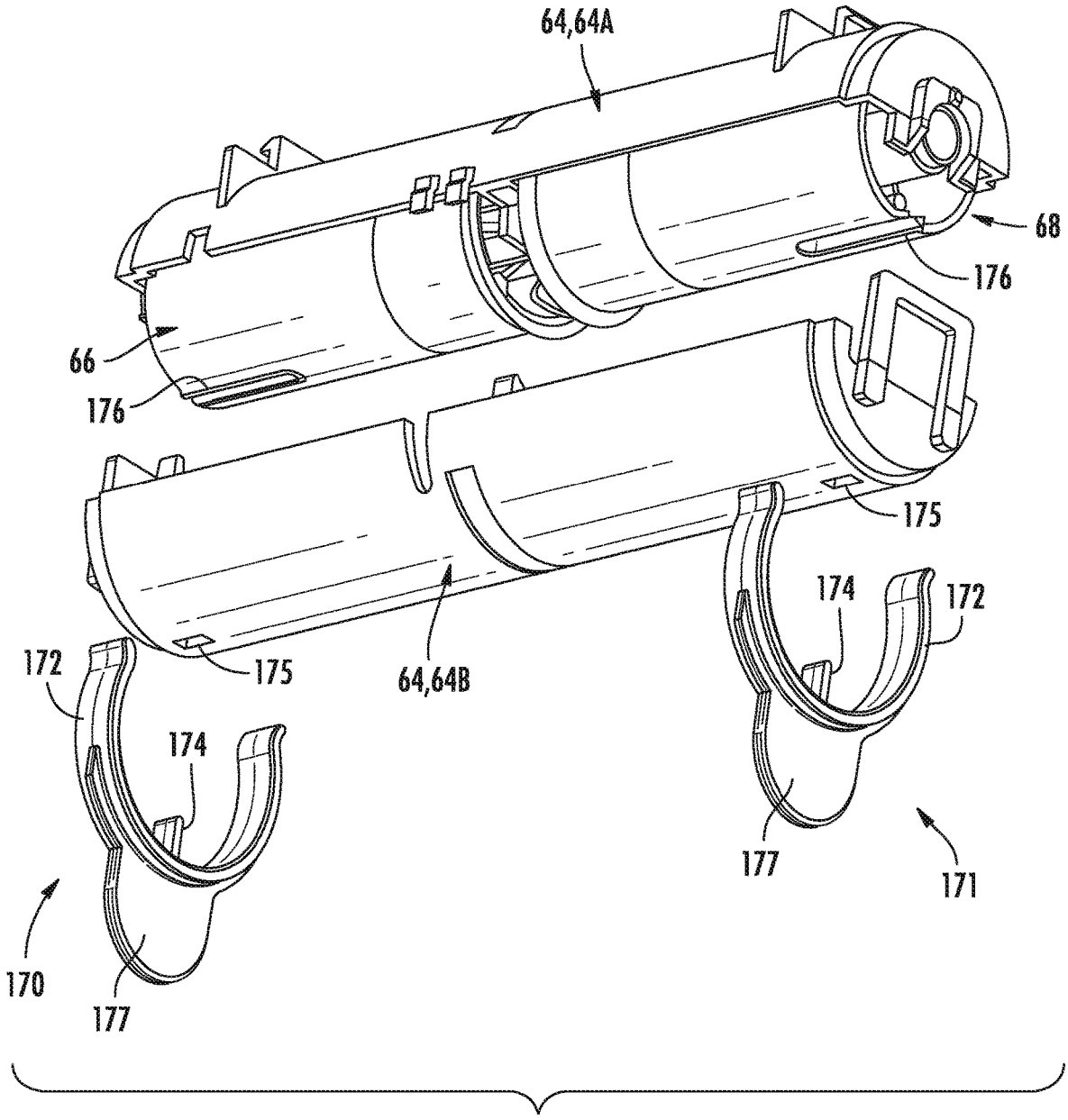
FIG. 13 illustrates a partially exploded, bottom perspective view of one of the lift stations shown in FIG. 9, particularly illustrating a lower housing component of the lift station and associated spool clips exploded away from the remainder of the lift station.

FIG. 13 illustrates a partially exploded, bottom perspective view of one of the lift stations 62 shown in FIG. 9, with the lower housing component 64B of the housing 64 and the spool clips 170, 171 being exploded away from the remainder of the lift station 62. As shown in FIG. 13, each spool clip 170, 171 includes a clip body 172 configured to be installed around the exterior of the station housing 64. For instance, in the illustrated embodiment, the clip body 172 defines a semi-circular or arcuate profile to allow the body 172 to be snapped or otherwise clipped onto the housing 64 around its outer perimeter. In such an embodiment, the radius of curvature or inner curved profile of the clip body 172 may, for example, be slightly smaller than the corresponding radius of curvature or outer curved profile of the housing 64 such that the clip body 172 flexes slightly outwardly as the spool clip 170, 171 is installed around the outer perimeter of the housing 64, thereby allowing the clip 170, 171 to be secured to the housing 64.

Additionally, as shown in FIG. 13, each spool clip 170, 171 includes a locking tab 174 extending inwardly from the clip body 172 that is configured to extend through the housing 64 and engage a portion of the respective lift spool 66, 68 when the spool clip 170, 171 is installed relative to the lift station 62. For example, in the illustrated embodiment, with the clip body 170, 171 installed along the outer perimeter of the housing 64, the locking tab 174 may extend through an opening 175 defined through the housing 64 (e.g., through the lower housing component 64B) and into a corresponding locking feature of the adjacent lift spool 66, 68, such as a slot or recess configured to receive the locking tab 174. For instance, in the illustrated embodiment, the locking tab 174 of each spool clip 170, 171 may be configured to be inserted into a cord slot 176 of each respective lift spool 66, 68 that is also used to couple the corresponding lift cord 48, 50 to the lift spool 66, 68 via a captured knot. Regardless, by configuring the locking tab 174 to extend through the housing 64 and into a corresponding locking feature 176 of the adjacent lift spool 66, 68, each spool clip 170, 171 may be used to rotationally fix its respective lift spool 66, 68 to the housing 64, thereby preventing relative rotation of the lift spools 66, 68 upon installation of the spool clips 170, 171.

It should be appreciated that, in one embodiment, each spool clip 170, 171 may also include a graspable tab or other feature for holding the spool clip 170, 171 during installation and/or removal of the clip 170, 171 relative to the lift station 62. For instance, as shown in FIG. 13, each spool clip 170, 171 may be provided with a handle 177 extending outwardly from the clip body 172 to allow the spool clip 170, 171 to be grasped during assembly.

Referring back to the embodiment of the assembly process shown in FIGS. 8-12, upon installation of the spool clips 170, 171, the lift stations 62 may be mounted or otherwise coupled to the top wall 110 of the bottom rail 102. Specifically, as indicated above, the lift stations 62 may be inserted within the interior of the bottom rail 102 via the open bottom end 112 and pushed towards the top wall 110 until the associated mounting hooks 65A, 65B of each lift station 62 snap into or otherwise engage the top wall 110 of the bottom rail 102 via the respective pair of station mounting apertures 126A, 126B (FIG. 9). As indicated above, the mounting hooks 65A, 65B and the associated station mounting apertures 126A, 126B may, in one embodiment, be shape, sized, and/or otherwise configured such that each lift station 62 can only be installed relative to the top wall 110 of the bottom rail 102 in a single orientation.

Figure 10:
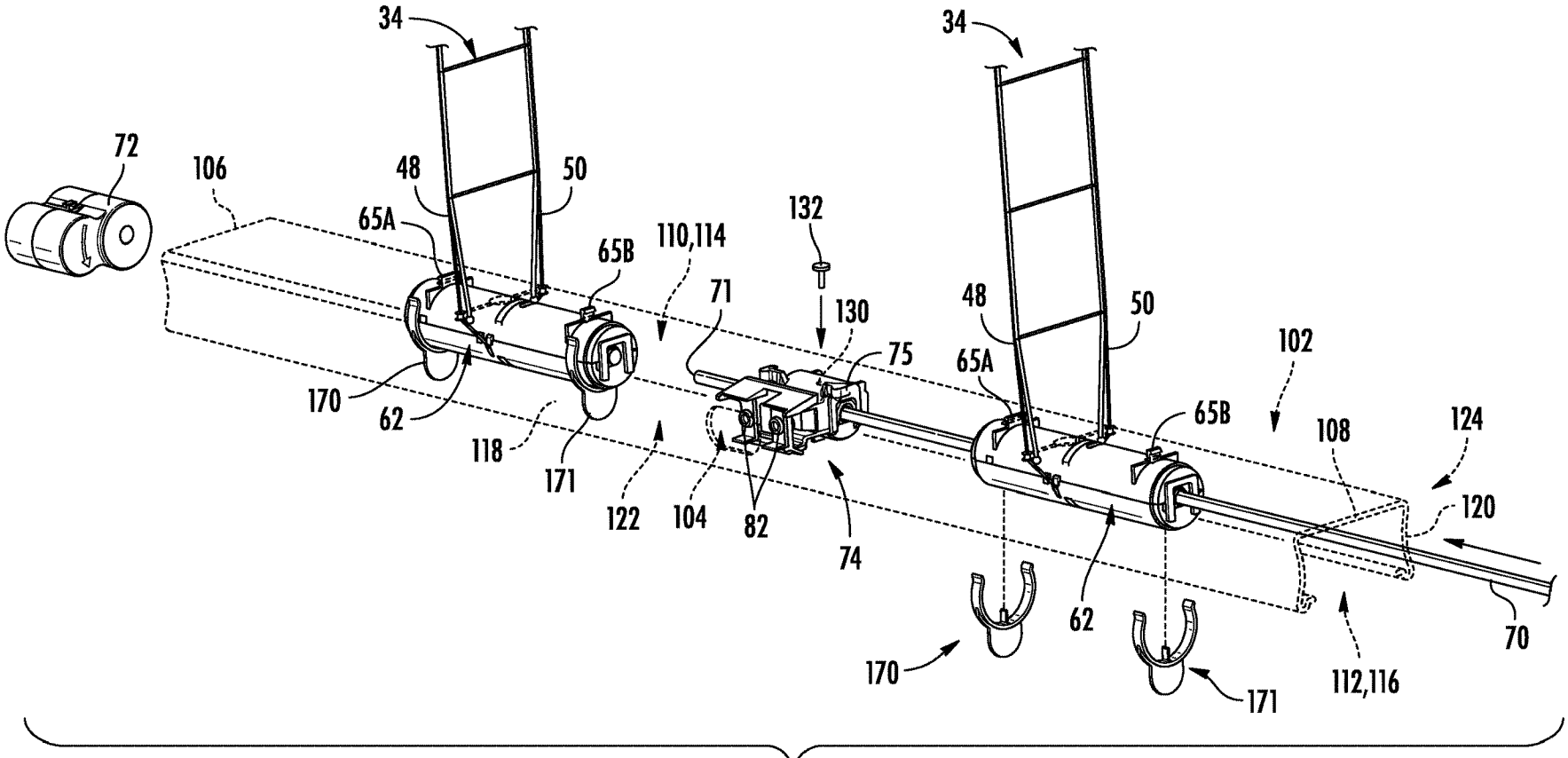
Figure 11:
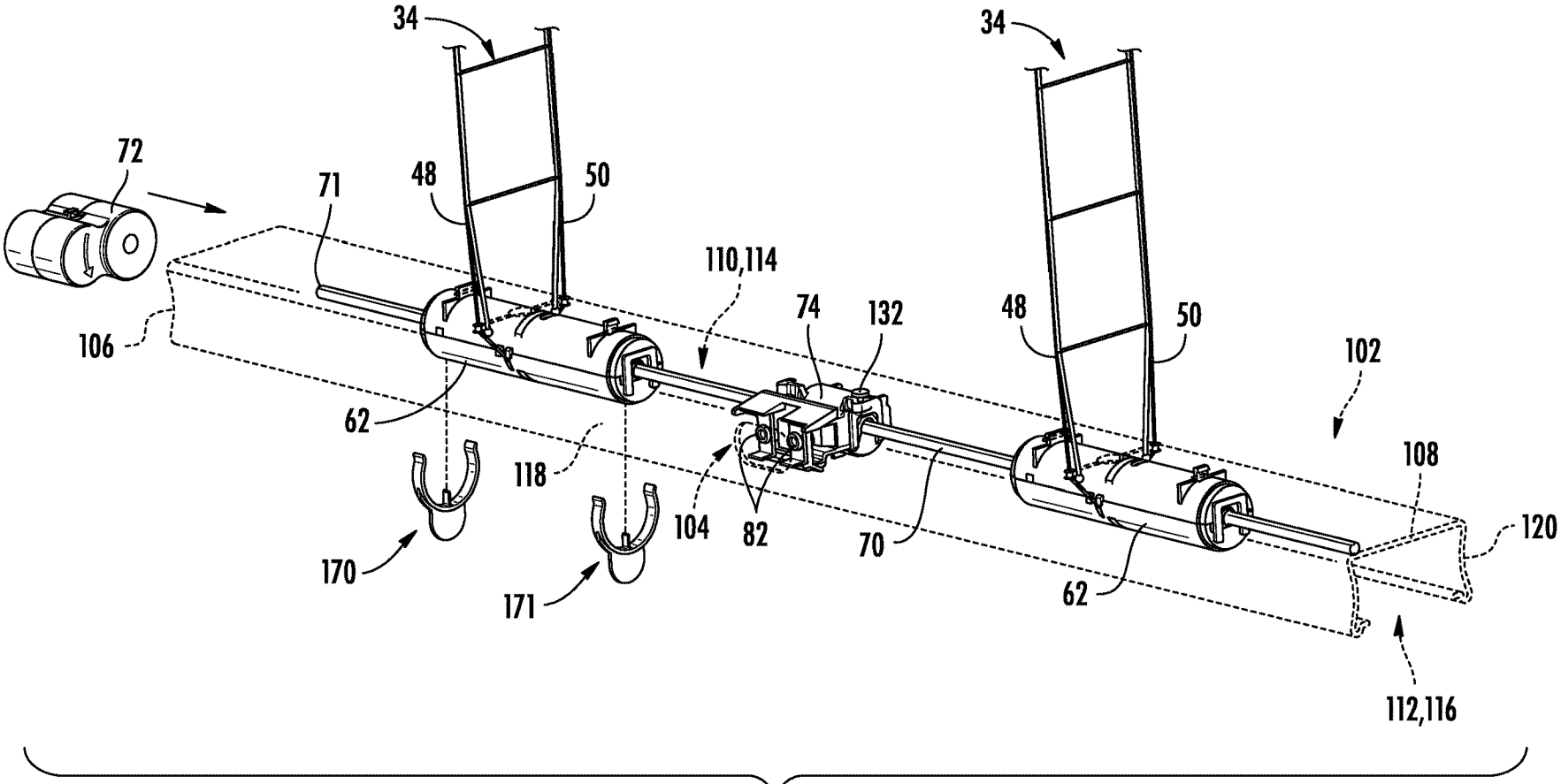

As shown in FIG. 10, in addition to the lift stations 62, the brake 74 is also configured to be mounted or otherwise coupled to the top wall 110 of the bottom rail 102. In one embodiment, upon installation of at least one of the lift stations 62 and the brake 74, the lift rod 70 may be partially installed within the bottom rail 102. Specifically, as shown in FIG. 10, a leading end 71 of the lift rod 70 may be inserted into the interior of the bottom rail 102 at one of its lateral ends (e.g., the second lateral end 108) and then through both the adjacent lift station 62 installed relative to such lateral end 108 and the brake 74. As shown in FIG. 11, the lift rod 70 may then be inserted through the remaining lift station 62. Additionally, as shown in FIGS. 10 and 11, upon inserting the lift rod 70 through each lift station 62, the corresponding spool clips 170, 171 may be removed therefrom, thereby rotationally disengaging the lift spools 66, 68 from their associating housing 64 such that the spools 66, 68 are configured to rotate relative to the housing 64 with rotation of the lift rod 70. In doing so, it may be desirable to remove the spool clips 170, 171 from the lift station 62 through which the lift rod 70 is initially inserted only after the lift rod 70 has also been inserted through the brake 74 and the brake 74 has otherwise been installed relative to the bottom rail 102 (e.g., similar to the assembly state shown in FIG. 10) to allow the brake 74 to prevent rotation of the lift rod 70 (and, thus, rotation of the lift spools 66, 68 relative to the station housing 64) following removable of the spool clips 170, 171.

As indicated above, the brake 74 may be configured to be positioned within the interior of the bottom rail 102 at or adjacent to the location of the button opening 104 defined through the first sidewall 118 of the rail 102. In such an embodiment, upon installing the lift rod 70 through the brake 74, the brake 74 may, for example, be moved axially or laterally along the length of the lift rod 70 (e.g., between the two lift stations 62) until the brake 74 is properly aligned relative to the button opening 104. For instance, as shown in FIGS. 10 and 11, the brake 74 may be positioned relative to the button opening 104 such that the fastener openings 82 defined in the brake 74 for coupling the button/housing 76, 78 (FIG. 2) to the brake 74 are aligned with the button opening 104. A suitable fastener (e.g., the pin 132 shown in FIGS. 10 and 11) may then be inserted through the brake mounting aperture 130 and into the corresponding mounting flange 75 (FIG. 10) of the brake 74 to couple the brake 74 to the top wall 110 of the bottom rail 102, thereby fixing the lateral positioning of the brake 74 within the bottom rail 102. It should be appreciated that, by configuring the bottom rail 102 to include mounting elements or features for assembling both the brake 74 and the button 76 relative to the rail 102, such components may be installed relative to each other in a more accurate and consistent manner during the assembly process.

Additionally, the spring motor 72 may be installed within the bottom rail 102 and coupled to one of the ends of the lift rod 70. For example, as shown in the sequence of views from FIG. 11 to FIG. 12, the spring motor 72 may be inserted through one of the lateral ends of the bottom rail 102 (e.g., the first lateral end 106) and onto the adjacent end of the lift rod 70. As is generally understood, it may be necessary to remove an associated motor pin (not shown) of the spring motor 72 to unlock or activate the motor 72 prior to operation of the associated lift system 60.

Figure 12:
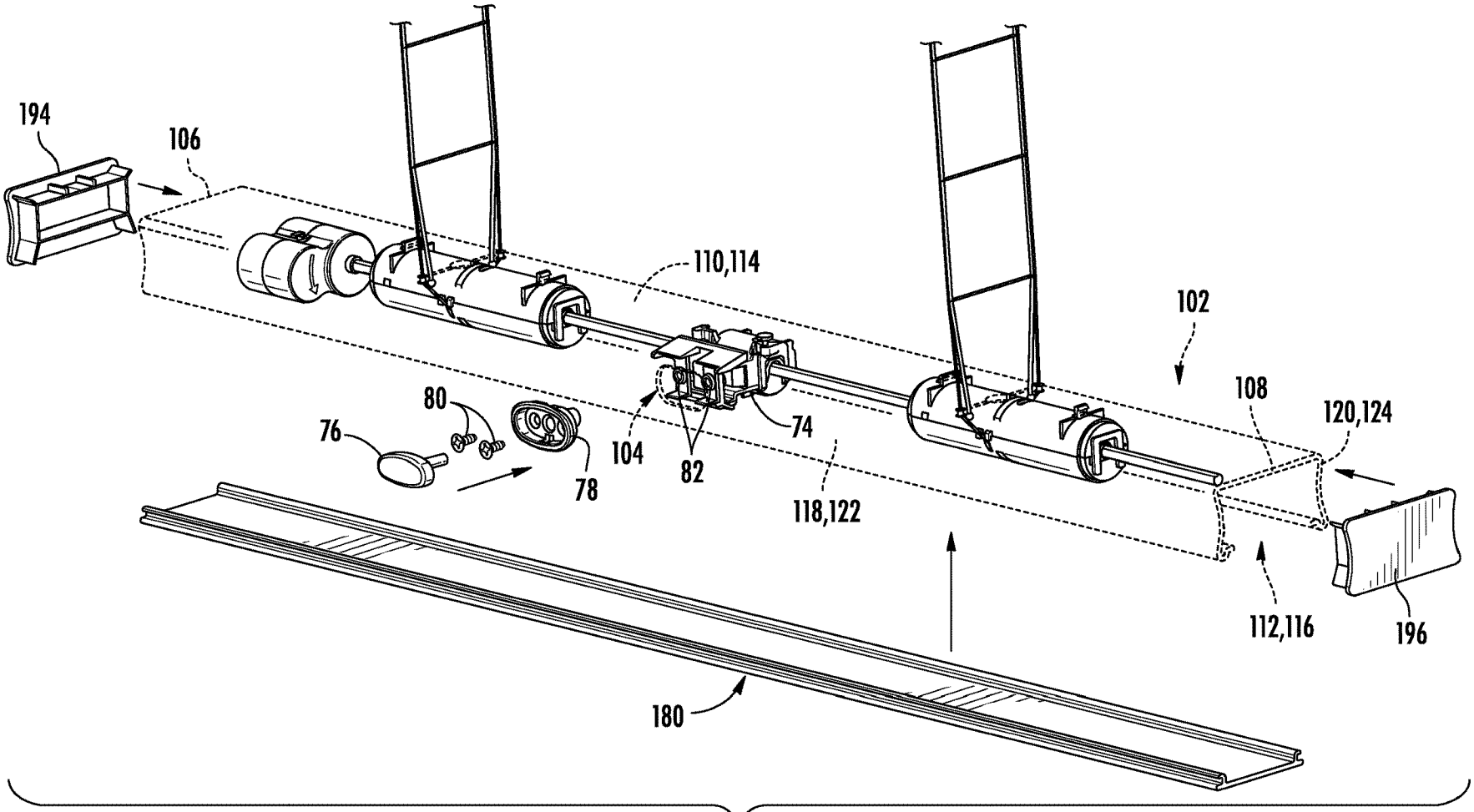

The assembly process described above with reference to FIGS. 8-12 generally provides one example of a method for assembling the various cords and internal lift system components of the covering 20 relative to the bottom rail 102. Thereafter, the various external components of the bottom rail assembly 100 may be installed relative to the bottom rail 102. For example, as shown in FIG. 12 and as described above with reference to FIGS. 2 and 5, the button 76 and associated button housing 78 may be installed relative to the button opening 104 defined along the front side 122 of the bottom rail 102. For instance, in one embodiment, the button housing 78 may be inserted into the opening 104 and subsequently coupled to the brake 74 (e.g., by inserting the associated fasteners 80 through the housing 78 and into the fastener openings 82 aligned with the button opening 104). The button 76 may then be installed within the button housing 78 to complete the button/housing installation relative to the rail 102.

Additionally, the cover 180 and associated endcaps 194, 196 may be installed relative to the bottom rail 120 to cover the open ends of the rail 102. For instance, as shown in FIG. 12 and as described above with reference to FIGS. 6 and 7, the cover 180 may be installed along the bottom side 116 of the rail 102, such as by snapping the cover 180 onto the bottom end 112 of the rail 102 or by sliding the cover 180 relative to the rail 102 along its bottom side 116. In addition, as shown in FIG. 12 and as described above with reference to FIG. 2, the endcaps 194, 196 may be installed onto the opposed lateral ends 106, 108 of the bottom rail 102.

Figure 14:
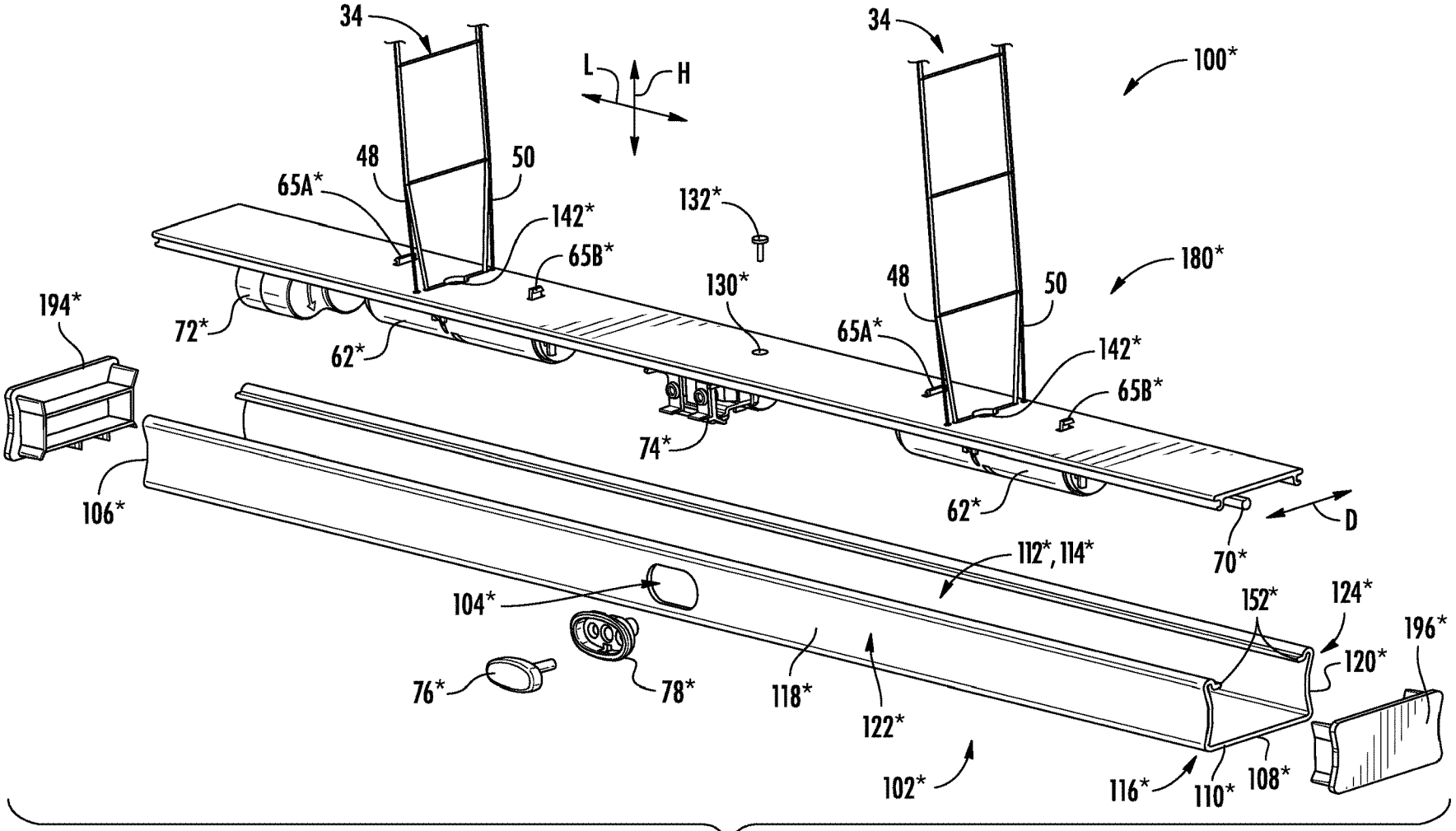
FIG. 14 illustrates a partially exploded view of another embodiment of a bottom rail assembly suitable for use within the disclosed covering in accordance with aspects of the present subject matter.
Figure 15:
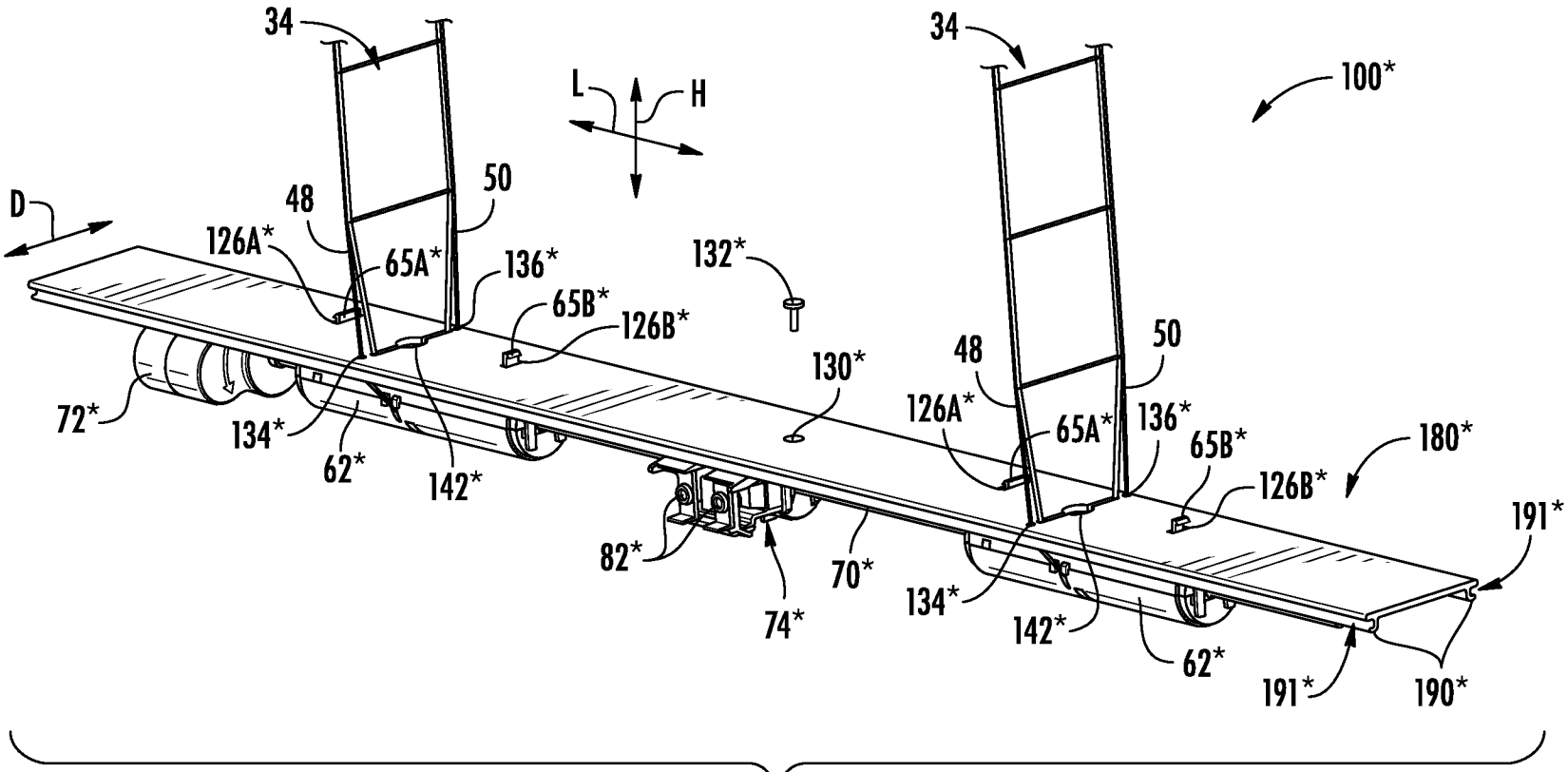
FIG. 15 illustrates a perspective view of the cover of the bottom rail assembly shown in FIG. 14, particularly illustrating various lift system component and associated cords of the disclosed covering installed relative to the cover in accordance with aspects of the present subject matter.

Referring now to FIGS. 14 and 15, differing views of an alternative embodiment of a bottom rail assembly 100* suitable for use with the disclosed covering 20 is illustrated in accordance with aspects of the present subject matter. In general, the various components and/or features of the bottom rail assembly 100* shown in FIGS. 14 and 15 are configured the same as or similar to the various components and/or features of the bottom rail assembly 100 described above with reference to FIGS. 1-13. As such, the components or features of the bottom rail assembly 100* that are the same or similar to corresponding components or features of the bottom rail assembly 100 described above with reference to FIGS. 1-13 will be designated by the same reference character with an asterisk (*) added. Additionally, when a given component or feature of the bottom rail assembly 100* is configured to generally perform the same function as the corresponding component or feature of the bottom rail assembly 100 described above with reference to FIGS. 1-13, a less detailed description of such component/feature will be provided with reference to FIGS. 14 and 15 for the sake of brevity.

As shown in FIGS. 14 and 15, the bottom rail assembly 100* generally includes the same components as the bottom rail assembly 100 described above, such as a bottom rail 102*, a cover 180*, first and second endcaps 194*, 196*, a button 76* and associated button housing 78*, and various lift system components (e.g., lift stations 62*, a lift rod 70*, a spring motor 72*, and a brake 74*). However, the orientation of the bottom rail 102* and cover 180* has been flipped relative to the orientation of such components in embodiment of the bottom rail assembly 100 described above with reference to FIGS. 1-13. Specifically, the orientation of the bottom rail 102* has been flipped such that the rail 102* is open-ended along its top side, with the cover 180* now being configured to be snapped onto the bottom rail 102* along its top side. In such an embodiment, as shown in FIGS. 14 and 15, one or more components of the lift system, such as the lift stations 62* and the brake 74*, are configured to be mounted directly to the cover 180* as opposed to the bottom rail 102*.

As shown in FIG. 14, the bottom rail 102* extends longitudinally in the lateral direction L between opposed first and second lateral ends 106*, 108*. In addition, in contrast to the upside-down "U-shaped" profile described above, the bottom rail 102* defines a right-side-up "U-shaped" profile and includes both a bottom wall 110* and an opposed open top end 112* extending in the lateral direction L between the first and second lateral ends 106*, 108* of the bottom rail 102*. The open top end 112* may generally be configured to define a top side 114* of the bottom rail 102* while the bottom wall 110* may generally be configured to define a bottom side 116* of the bottom rail 102*. Additionally, as shown in FIG. 14, the bottom rail 102* includes opposed first and second sidewalls 118*, 120* spaced apart from each other in the depthwise direction arrow D and extending directly between the bottom wall 110* and the top end 112* of the bottom rail 102* in the heightwise direction H so as to define opposed front and rear sides 122*, 124* of the bottom rail 102*.

Additionally, as indicated above, due to the reversed or flipped orientation of the bottom rail 102* and the cover 180*, one or more of the lift system components are configured to be mounted to the cover 180* as opposed to the bottom rail 102*. In such an embodiment, the cover 180* may be provided with the same or a similar aperture arrangement as that described above with reference to embodiment of the bottom rail 102 shown FIGS. 3-5. For example, one or more station mounting apertures may be defined in the cover 180* for coupling each lift station 62* thereto. For instance, as particularly shown in FIG. 15, the mounting hooks 65A, 65B* of each lift station 62* are configured to be inserted through respective pairs of station mounting apertures 126A*, 126B* defined in the cover 180* to allow the lift stations 62* to be secured to the cover 180*. In addition, one or more brake mounting apertures may be defined in the cover 180* for coupling the brake 74* thereto. For instance, as shown in FIGS. 14 and 15, a brake mounting aperture 130* is defined through the cover 180* for receiving a suitable fastener (e.g., pin 132*) configured to couple the brake 74* to the cover 180*.

Moreover, similar to the aperture arrangement described above with reference to embodiment of the bottom rail 102 shown FIGS. 3-5, various cord apertures may be defined in the cover 180* for receiving the associated cords of the covering 20. For instance, as shown in FIG. 15, pairs of front and rear lift cord apertures 134*, 136* are defined through the cover 180* for routing the respective pairs of front and rear lift cords 48, 50 through the cover 180*. Additionally, as shown in FIGS. 14 and 15, a cord ladder aperture 142 is defined in the cover 180* for coupling the each cord ladder 34 to the cover 180*.

In one embodiment, following assembly of the various lift system components and associated cords relative to the cover 180*, the cover 180* may then be coupled to the bottom rail 102* along its open top end 112*. Specifically, similar to the embodiment of the rail/cover described above with reference to FIGS. 6 and 7, the cover 180* may be configured to be snapped onto the bottom rail 102* or vice versa. For example, as shown in FIG. 15, the cover includes hooked retention walls 190* defining opposed retention slots 191* along each edge of the cover 180*. Similarly, as shown in FIG. 14, the bottom rail 102* includes corresponding retention flanges 152* extending inwardly from the opposed sidewalls 118*, 120* of the bottom rail 102* along the rail's top side 114*. In such an embodiment, the cover 180* and bottom rail 102* may be pressed together until the retention walls 190* clear the retention flanges 152*, at which point the hooked walls 190* may snap over and/or behind the flanges 152* to trap the flanges 152* within the retention slots 191* defined along the opposed edges of the cover 180*, thereby securing the cover 180* to the bottom rail 102*.

In addition, it should be appreciated that the various external components of the bottom rail assembly 100* may be configured to be installed relative to the bottom rail 102* in the same manner at that described above with reference to FIGS. 1-12. For instance, as shown in FIG. 14, a button opening 104* is defined through the first sidewall 118* of the bottom rail 102* for installing the button 76* and associated button housing 78* relative to the rail 102*. For example, once the cover 180* has been installed relative to the bottom rail 102*, a portion of the button housing 78* may be inserted through the butting opening 104* and coupled to the brake 74* via the aligned fastener openings 82* (FIG. 15). The button 76* may then be installed within the housing 78* along the exterior of the bottom rail 102*. Moreover, as shown in FIG. 14, the first and second endcaps 194*, 196* are configured to be installed at the first and second lateral ends 106*, 108*, respectively, of the bottom rail 102*.

While the foregoing Detailed Description and drawings represent various embodiments, it will be understood that various additions, modifications, and substitutions may be made therein without departing from the spirit and scope of the present subject matter. Each example is provided by way of explanation without intent to limit the broad concepts of the present subject matter. In particular, it will be clear to those skilled in the art that principles of the present disclosure may be embodied in other forms, structures, arrangements, proportions, and with other elements, materials, and components, without departing from the spirit or essential characteristics thereof. For instance, features illustrated or described as part of one embodiment can be used with another embodiment to yield a still further embodiment. Thus, it is intended that the present subject matter covers such modifications and variations as come within the scope of the appended claims and their equivalents. One skilled in the art will appreciate that the disclosure may be used with many modifications of structure, arrangement, proportions, materials, and components and otherwise, used in the practice of the disclosure, which are particularly adapted to specific environments and operative requirements without departing from the principles of the present subject matter. For example, elements shown as integrally formed may be constructed of multiple parts or elements shown as multiple parts may be integrally formed, the operation of elements may be reversed or otherwise varied, the size or dimensions of the elements may be varied. The presently disclosed embodiments are therefore to be considered in all respects as illustrative and not restrictive, the scope of the present subject matter being indicated by the appended claims, and not limited to the foregoing description.

In the foregoing Detailed Description, it will be appreciated that the phrases "at least one", "one or more", and "and/or", as used herein, are open-ended expressions that are both conjunctive and disjunctive in operation. The term "a" or "an" element, as used herein, refers to one or more of that element. As such, the terms "a" (or "an"), "one or more" and "at least one" can be used interchangeably herein. All directional references (e.g., proximal, distal, upper, lower, upward, downward, left, right, lateral, longitudinal, front, rear, top, bottom, above, below, vertical, horizontal, crosswise, radial, axial, clockwise, counterclockwise, and/or the like) are only used for identification purposes to aid the reader's understanding of the present subject matter, and/or serve to distinguish regions of the associated elements from one another, and do not limit the associated element, particularly as to the position, orientation, or use of the present subject matter. Connection references (e.g., attached, coupled, connected, joined, secured, mounted and/or the like) are to be construed broadly and may include intermediate members between a collection of elements and relative movement between elements unless otherwise indicated. As such, connection references do not necessarily infer that two elements are directly connected and in fixed relation to each other. Identification references (e.g., primary, secondary, first, second, third, fourth, etc.) are not intended to connote importance or priority, but are used to distinguish one feature from another.

It should be understood that, as described herein, an "embodiment" (such as illustrated in the accompanying Figures) may refer to an illustrative representation of an environment or article or component in which a disclosed concept or feature may be provided or embodied, or to the representation of a manner in which just the concept or feature may be provided or embodied. However such illustrated embodiments are to be understood as examples (unless otherwise stated), and other manners of embodying the described concepts or features, such as may be understood by one of ordinary skill in the art upon learning the concepts or features from the present disclosure, are within the scope of the disclosure. In addition, it will be appreciated that while the Figures may show one or more embodiments of concepts or features together in a single embodiment of an environment, article, or component incorporating such concepts or features, such concepts or features are to be understood (unless otherwise specified) as independent of and separate from one another and are shown together for the sake of convenience and without intent to limit to being present or used together. For instance, features illustrated or described as part of one embodiment can be used separately, or with another embodiment to yield a still further embodiment. Thus, it is intended that the present subject matter covers such modifications and variations as come within the scope of the appended claims and their equivalents.

All apparatuses and methods disclosed herein are examples of apparatuses and/or methods implemented in accordance with one or more principles of the present subject matter. These examples are not the only way to implement these principles but are merely examples. Thus, references to elements or structures or features in the drawings must be appreciated as references to examples of embodiments of the present subject matter, and should not be understood as limiting the disclosure to the specific elements, structures, or features illustrated. Other examples of manners of implementing the disclosed principles will occur to a person of ordinary skill in the art upon reading this disclosure.

This written description uses examples to disclose the present subject matter, including the best mode, and also to enable any person skilled in the art to practice the present subject matter, including making and using any devices or systems and performing any incorporated methods. The patentable scope of the present subject matter is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

The following claims are hereby incorporated into this Detailed Description by this reference, with each claim standing on its own as a separate embodiment of the present disclosure. In the claims, the term "comprises/comprising" does not exclude the presence of other elements or steps. Furthermore, although individually listed, a plurality of means, elements or method steps may be implemented by, e.g., a single unit or processor. Additionally, although individual features may be included in different claims, these may possibly advantageously be combined, and the inclusion in different claims does not imply that a combination of features is not feasible and/or advantageous. In addition, singular references do not exclude a plurality. The terms "a", "an", "first", "second", etc., do not preclude a plurality. Reference signs in the claims are provided merely as a clarifying example and shall not be construed as limiting the scope of the claims in any way.

What is claimed is:

1. A covering for an architectural structure, said covering comprising:

a headrail assembly;

a bottom rail assembly supported relative to said headrail assembly via one or more lift cords, said bottom rail assembly comprising:

a bottom rail including a top wall extending along a top side of said bottom rail, said bottom rail further including opposed first and second sidewalls extending from said top wall along respective first and second sides of said bottom rail towards a bottom side of said bottom rail, said top wall of said bottom rail defining at least one mounting aperture;

a lift system positioned within an interior of said bottom rail and operable to raise and lower said bottom rail assembly relative to said head rail assembly by adjusting an effective length of said one or more lift cords extending between said headrail and bottom rail assemblies, said lift system including at least one system component, said at least one system component comprising at least one mounting element configured to be inserted into said at least one mounting aperture, said at least one mounting element and said at least one mounting aperture being configured to provide a snap-fit connection between said system component and said top wall of said bottom rail; and a user actuatable component positioned relative to one of said first sidewall or said second sidewall along an exterior of said bottom rail, said user actuatable component configured to be actuated to control an operation of said lift system, wherein:

said at least one mounting element comprises a first mounting element and a second mounting element, said first mounting element being sized or shaped differently than said second mounting element;

said at least one mounting aperture comprises a first mounting aperture and a second mounting aperture, said first mounting aperture being sized or shaped differently than said second mounting aperture; and said first mounting element is configured such that said first mounting element can only be inserted through one of said first mounting aperture or said second mounting aperture when installing said system component relative to said top wall of said bottom rail.

2. The covering of claim 1, wherein:

said bottom rail defines an open bottom end between said first and second sidewalls along said bottom side of said bottom rail; and said bottom rail assembly further comprises a separate cover extending along said bottom side of said bottom rail.

3. The covering of claim 2, wherein:

said bottom rail includes opposed first and second retention flanges extending inwardly from said first and second sidewalls, respectively, along said bottom side of said bottom rail; and said cover defines first and second retention walls configured to snap into position relative to said first and second retention flanges, respectively, as said cover is pressed against said bottom rail.

4. The covering of claim 1, wherein:

said at least one system component comprises a lift station of said lift system.

5. The covering of claim 1, wherein:

said top wall of said bottom rail defines an inner surface and an outer surface, with t said first and second mounting aperture extending through said top wall from said inner surface to said outer surface;

said first and second mounting elements comprise first and second mounting hooks, said first mounting hook configured to be inserted into said one of said first mounting aperture or said second mounting along said inner surface of said top wall;

a portion of said first mounting hook is configured engage said outer surface of said top wall upon said portion of said first mounting hook being inserted through said one of said mounting aperture or second mounting aperture.

6. A covering for an architectural structure, said covering comprising:

a headrail assembly;

a bottom rail assembly supported relative to said headrail assembly via one or more lift cords, said bottom rail assembly comprising:

a bottom rail including a first sidewall and a second sidewall, said first sidewall extending along a front side of said bottom rail between opposed top and bottom sides of said bottom rail and said second sidewall extending along a rear side of said bottom rail between said opposed top and bottom sides, said bottom rail further including a third wall extending between said first and second sidewalls along one of said top side or said bottom side of said bottom rail and first and second rail retention elements provided in operative association with said first and second sidewalls, respectively;

a separate cover configured to be coupled to the bottom rail such that said bottom rail and said cover at least partially define an interior volume of said bottom rail assembly, said cover including first and second cover retention members configured to be snapped into position relative to said first and second rail retention elements, respectively, of said bottom rail to secure said cover to said bottom rail; and a lift system comprising least one system component mounted to one of said third wall of said bottom rail or said cover such that said at least one system component is supported within said interior volume of said bottom rail assembly by said one of said bottom rail or said cover;

wherein:

said one of said third wall of said bottom rail or said cover defines a first mounting aperture and a second mounting aperture, said first mounting aperture being sized or shaped differently than said second mounting aperture;

said at least one system component comprises a first mounting element and a second mounting element, said first mounting element being sized or shaped differently than said second mounting element;

said first and second mounting elements and said first and second mounting apertures are configured to provide a snap-fit connection between said system component and said one of said third wall of said bottom rail or said cover; and said first mounting element is configured such that said first mounting element can only be inserted through one of said first mounting aperture or said second mounting aperture when installing said system component relative to said bottom rail.

7. The covering of claim 6, wherein:

said third wall comprises a top wall of said bottom rail extending along said top side of said bottom rail between said first and second sidewalls; and said at least one system component is mounted to said top wall of said bottom rail via said snap-fit connection such that said at least one system component is supported within said interior volume of said bottom rail assembly between said first and second sidewalls of said bottom rail by said top wall.

8. The covering of claim 6, wherein:

said third wall comprises a bottom wall of said bottom rail extending along said bottom side of said bottom rail between said first and second sidewalls; and said at least one system component is mounted to said cover via said snap-fit connection such that said at least one system component is supported within said interior volume of said bottom rail assembly between said first and second sidewalls of said bottom rail by said cover.

9. The covering of claim 6, wherein:

said first and second retention elements comprise opposed first and second retention flanges extending inwardly from said first and second sidewalls, respectively, along said bottom side of said bottom rail; and said first and second retention members comprise first and second retention walls configured to snap into position relative to said first and second retention flanges, respectively, as said cover is pressed against said bottom rail.

10. The covering of claim 6, wherein:

said at least one system component comprises a lift station of said lift system.

11. The covering of claim 6, wherein:

said one of said third wall of said bottom rail or said cover defines an inner surface and an outer surface, with said first and second mounting apertures extending through said one of said third wall of said bottom rail or said cover from said inner surface to said outer surface;

said first and second mounting elements comprise first and second mounting hooks, said first mounting hook configured to be inserted into said one of said first mounting aperture or said second mounting along said inner surface of said one of said third wall of said bottom rail or said cover;

a portion of said first mounting hook is configured to engage said outer surface of said one of said third wall of said bottom rail or said cover upon said portion of said first mounting hook being inserted through said one of said first mounting aperture or said second mounting aperture.

* * * * *